US012797667B2

(12) United States Patent
Chiang

(10) Patent No.: US 12,797,667 B2
(45) Date of Patent: Nov. 17, 2026

(54) ANGLE-ADJUSTABLE SMITH MACHINE

(71) Applicant: Ming-Hui Lin, Kaohsiung City (TW)

(72) Inventor: Hsueh-Chun Chiang, Kaohsiung City (TW)

(73) Assignee: Ming-Hui Lin, Kaohsiung City (TW)

( * ) Notice: Subject to any disclaimer, the term of this patent is extended or adjusted under 35 U.S.C. 154(b) by 119 days.

(21) Appl. No.: 18/957,003

(22) Filed: Nov. 22, 2024

(65) Prior Publication Data

US 2025/0195938 A1 Jun. 19, 2025

(30) Foreign Application Priority Data

Dec. 14, 2023 (TW) ..... 112213659

(51) Int. Cl.
*A63B 21/062* (2006.01)
*A63B 21/072* (2006.01)
*A63B 21/078* (2006.01)

(52) U.S. Cl.
CPC ..... *A63B 21/0622* (2015.10); *A63B 21/0626* (2015.10); *A63B 21/0724* (2013.01); *A63B 21/078* (2013.01)

(58) Field of Classification Search
CPC ..... A63B 21/062–0632
See application file for complete search history.

(56) References Cited

U.S. PATENT DOCUMENTS

| | | | | |
|---|---|---|---|---|
| 7,070,546 | B1 * | 7/2006 | Grasso | A63B 21/072 482/145 |
| D974,506 | S * | 1/2023 | Qi | D21/686 |
| 12,280,306 | B1 * | 4/2025 | Wang | A63B 23/1236 |
| 12,318,657 | B1 * | 6/2025 | Nolan | A63B 17/04 |
| 12,415,109 | B1 * | 9/2025 | Wang | A63B 21/068 |
| 2019/0275363 | A1 * | 9/2019 | Jones | A63B 21/06 |
| 2020/0306582 | A1 * | 10/2020 | Berg | A63B 21/4035 |
| 2022/0219033 | A1 * | 7/2022 | Lee | A63B 21/00072 |
| 2024/0307729 | A1 * | 9/2024 | Nolan | A63B 1/00 |
| 2025/0090894 | A1 * | 3/2025 | Gong | A63B 21/154 |

FOREIGN PATENT DOCUMENTS

| | | | | |
|---|---|---|---|---|
| CN | 212090689 U | | 12/2020 | |
| CN | 112891824 A | * | 6/2021 | A63B 21/078 |
| CN | 219539357 U | * | 8/2023 | |

* cited by examiner

*Primary Examiner* — Joshua T Kennedy
(74) *Attorney, Agent, or Firm* — Rosenberg, Klein & Lee

(57) ABSTRACT

An angle-adjustable Smith machine includes a base; an upper frame, located at a height from the base and having two slide slot brackets; two front poles each having a bottom end pivotally connected to the base and a top end coupled to the slide slot brackets; two rear poles, connected between the base and the upper frame; and at least one angle adjustment unit, disposed on the corresponding slide slot bracket and connected to the top end. The angle adjustment unit is configured for driving the top end of the front pole to move in an X direction and then to be secured, so that the bottom end of the front pole is pivoted in the X direction for the front pole to be adjusted at a predetermined angle.

17 Claims, 27 Drawing Sheets

ANGLE-ADJUSTABLE SMITH MACHINE

FIELD OF THE INVENTION

The present invention relates to an angle-adjustable Smith machine, and more particularly to a Smith machine having angle adjustment units for adjusting the angles of front poles.

BACKGROUND OF THE INVENTION

In general, barbell training is performed using a Smith machine to facilitate various weightlifting exercises, such as squats or bench presses.

As disclosed in Chinese Utility Model Publication No. CN219539357, published on Aug. 18, 2023, a multi-functional Smith machine comprises a fly part, a high handlebar part, a low handlebar part, a weight disk part, a barbell device, and a barbell holder part. The fly part, the low handlebar part and the barbell holder part are disposed on front poles. The high handlebar part is disposed on a horizontal connecting frame. The weight disk part is disposed on a left floor stand. The fly part is connected to the weight disk part through a pulley set. This machine has the low handlebar part (dip bars), the barbell holder part (for free squat, weightlifting), the fly part, and a pull-up function, allowing for effective training different parts of the body. This machine can be adjusted according to different training requirements, such as height, front and back, weights, etc. Diversified adjustment mechanisms in cooperation with various exercise devices make fitness exercises no longer monotonous, safe and comfortable.

As disclosed in Chinese Utility Model Publication No. CN212090689, published on Dec. 8, 2020, a multi-functional Smith machine comprises a counterweight mechanism, a hanger mechanism, a support steering beam mechanism, a weightlifting bar, a left front stand, and a right front stand. The left front stand and the right front stand are hollow stands. The counterweight mechanism includes two sets of counterweights that are arranged symmetrically, steel cables, and pulleys. The two sets of counterweights are disposed inside the left front stand and the right front stand, and are connected to the weightlifting bar through the steel cables and the pulleys. This machine realizes a three-in-one compact design of the counterweight mechanism, the hanger mechanism and the support steering beam mechanism.

As disclosed in the above-mentioned patents, the front poles are fixed and cannot be relatively pivoted at an angle inwardly. When the barbell straddles the barbell holders of the front poles and the weight disks at both ends of the barbell are too heavy, the weight disks at both ends of the barbell will have a slight sag. Thus, when the barbell is to be lifted from the barbell holders, the weight disks will easily touch the barbell holders and hinder the lifting of the barbell. If the front poles can be relatively pivoted at an angle inwardly, the weight disks will not touch the barbell holders. The Smith machines provided by the above-mentioned patents are not ideal in use.

SUMMARY OF THE INVENTION

In view of the above-mentioned shortcomings, the primary object of the present invention is to provide an angle-adjustable Smith machine, comprising a base, an upper frame, two front poles, two rear poles, and at least one angle adjustment unit. The upper frame is located at a height from the base in a z direction. The upper frame includes two slide slot brackets. The two front poles are spaced apart from each other in an X direction. The two front poles extend in the Z direction. The front poles each have a bottom end pivotally connected to the base and a top end coupled to the corresponding slide slot bracket. The two rear poles are spaced apart from each other in the X direction. The two rear poles are located at a distance away from the two front poles in a Y direction. The two rear poles extend in the Z direction and are connected between the base and the upper frame. The X direction, the Y direction and the Z direction are perpendicular to one another. The angle adjustment unit is disposed on the slide slot bracket. The angle adjustment unit is connected to the top end of the front pole. The angle adjustment unit is configured for driving the top end of the front pole to move in the X direction and then to be secured, so that the bottom end of the front pole is pivoted in the X direction for the front pole to be adjusted at a predetermined angle.

Preferably, the slide slot bracket has a slide slot in the X direction. The angle adjustment unit includes a driving rod, a driven rod, and an operating handle. The driving rod has two ends defined as a first end and a second end. The first end is pivotally connected to the slide slot bracket via a first shaft. The second end is connected to a restricting portion. The operating handle is pivotally connected to the restricting portion. A slot is formed between the first end and the second end. The driven rod has two end portions defined as a first end portion and a second end portion. The first end portion is secured to the top end through a second shaft passing through the slide slot, such that the second shaft is movable within the slide slot to drive the top end to pivot relative to the bottom end. The second end portion is pivotally connected to a third shaft fixed in the slot.

Preferably, the restricting portion has a plurality of positioning apertures arranged in an arc from the X direction toward the Y direction. A locking member is formed on the operating handle. The locking member is selectively locked in one of the positioning apertures.

Preferably, the driven rod is composed of two plates connected to each other.

Preferably, the angle-adjustable Smith machine further comprises two movable poles, a plurality of positioning pins, and two force-applying rods. The two front poles are hollow poles and each have a slide groove and a stop groove in the Z direction. The two movable poles are slidably inserted in the two front poles in the Z direction, respectively. The two movable poles each include at least one barbell holder. The barbell holders of the two movable poles are exposed on the two front poles. The two movable poles each have a plurality of positioning holes arranged in the Z direction and corresponding in position to the stop groove. The plurality of positioning pins are selectively inserted in the positioning holes. The two force-applying rods are pivotally connected to the respective front poles. The two force-applying rods are movable to support exposed portions of the respective positioning pins. Through leverage, the movable poles are movable up or down with less effort to relocate the positioning pins. By relocating the positioning pins in different ones of the positioning holes, the positions of the barbell holders are adjustable in the Z direction.

Preferably, the front pole includes a shaft holder and a first pivot shaft on the shaft holder. The first pivot shaft is pivotally connected to one end of a connecting plate. Another end of the connecting plate is pivotally connected to the force-applying rod through a second pivot shaft. The force-applying rod has a hook portion extending forward from the second pivot shaft. The force-applying rod is swingable between the front pole and the rear pole.

Preferably, the shaft holder has a rotary shaft parallel to the Z direction. A rotary seat is pivotally connected to the rotary shaft. The rotary seat has an extension end pivotally connected to the first pivot shaft. The first pivot shaft is perpendicular to the rotary shaft.

Preferably, the at least one barbell holder includes two barbell holders on each of the two movable poles in the Z direction. The two barbell holders are defined as an upper barbell holder and a lower barbell holder.

Preferably, the upper barbell holder is located away from the base and has an upper roller. The upper roller is a cylindrical roller. An axis of the upper roller is parallel to the Y direction. The lower barbell holder is located close to the base and has a lower roller. An axis of the lower roller is parallel to the Y direction. A circumference of the lower roller has a recessed portion in the Y direction.

Preferably, the angle-adjustable Smith machine further comprises two safety racks. A plurality of safety rack positioning holes are formed on the front pole in the Z direction and are located close to the base. The two safety racks each have a U-shaped mount corresponding to the safety rack positioning holes. An inner wall of the U-shaped mount has protrusions. The protrusions are selectively engaged in the safety rack positioning holes from different planes, so that the U-shaped mount surrounds the front pole and is selectively secured at different positions in the Z direction.

Preferably, the base includes two outwardly-expanding feet. The two outwardly-expanding feet are expanded from the rear poles toward the front poles.

Preferably, the two rear poles are disposed obliquely in the Z direction. A distance between the two rear poles in the X direction gradually increases from the upper frame toward the base. A distance between the rear pole and the front pole in the Y direction gradually increases from the upper frame toward the base. The front poles are parallel to the Z direction.

Preferably, the upper frame includes a pull-up bar. The pull-up bar is straddled between the front poles.

Preferably, the angle-adjustable Smith machine further comprises at least one weight disk holder. The rear pole has a plurality of weight disk holder positioning holes arranged in a lengthwise direction of the rear pole. The weight disk holder has a U-shaped seat corresponding to the weight disk holder positioning holes. An inner wall of the U-shaped seat has at least one protruding portion. The protruding portion is selectively engaged in the corresponding weight disk holder positioning hole from different planes, so that the U-shaped seat surrounds the rear pole and is selectively secured at different positions in the Z direction.

Preferably, the weight disk holder is movably pivoted to the U-shaped seat through a pivot member. The weight disk holder is rotatable by 90 degrees relative to the U-shaped seat in the lengthwise direction of the rear pole through the pivot member.

Preferably, the upper frame includes a barbell bar holder. The barbell bar holder includes two holding pieces. A spacing between the two holding pieces is less than a protruding section of a barbell bar.

The above technical features have the following advantages:

1. Through the structure of the angle-adjustable Smith machine, the angles of the front poles can be adjusted relative to each other to make a space for weightlifting, which can prevent the weight disks from touching the barbell holders of the front poles.
2. The front poles can be firmly connected to the upper frame at the adjusted angle to maintain the rigidity of the Smith machine.
3. The operating handle has an appropriate length, so that its force arm is longer, making it easier to adjust the angle of the front pole.
4. After the angle of the front pole is adjusted, the operating handle is pulled outward in the Y direction and then the operating handle is rotated for the locking member on the operating handle to be locked in another positioning aperture, so that the operating handle is hidden behind the front pole.
5. Through the structure of the Smith machine, the height of the barbell holder can be adjusted quickly and effortlessly. The force-applying rod can elevate or lower the movable pole relative to the front pole through leverage, and the two positioning pins are relocated up and down in turns so that the movable pole can be elevated or lowered to the required height. In the same way, the force-applying rod on the other side can elevate or lower the corresponding movable pole to the same height, so that the barbell holders can be quickly adjusted to different heights with less effort for weight-lifting exercise such as squat or bench press.
6. The barbell bar of the barbell can be selectively placed between the two upper rollers, and the position of the barbell can be adjusted left or right in the X direction through the two upper rollers able to roll in the X direction, so as to facilitate the lifting of the barbell during exercise.
7. The barbell bar of the barbell can be selectively placed between the two lower rollers. The barbell is placed between the two recessed portions of the two lower rollers, so that the barbell can be quickly separated from the two recessed portions when the barbell is lifted during exercise.
8. The safety racks can be secured at different heights of the two front poles. When the barbell slips due to an accidental mistake during the weightlifting exercise such as bench press, the two safety racks can catch the barbell to avoid accidental injuries.
9. The protrusions are selectively engaged in the safety rack positioning holes from different planes, so that the U-shaped mount of the safety rack surrounds the front pole and is selectively secured at different positions in the Z direction. Through the protrusions engaged in the corresponding safety rack positioning holes and the U-shaped mount surrounding three sides of the front pole, the safety rack is positioned better and able to support a larger load, thereby improving safety.
10. The protruding portions are selectively engaged in the corresponding weight disk holder positioning holes from different planes, so that the U-shaped seat surrounds the rear pole and is selectively secured at different positions in the Z direction. Through the protruding portions engaged in the corresponding weight disk holder positioning holes and the U-shaped seat surrounding three sides of the rear pole, the weight disk holder is positioned better and able to support a larger load, thereby preventing the rear pole from shaking and increasing the stability of the weight disk holder and preventing the weight disk holder from coming off.
11. The disassembled weight disks can be hung on the weight disk holders. The weight disk holder can be rotated by 90 degrees in the lengthwise direction of the rear pole relative to the U-shaped seat through the pivot member, thereby changing the hanging direction of the weight disk to avoid obstructing access to the Smith machine.

12. The disassembled barbell bar can be held by the barbell bar holder of the upper frame. The two holding pieces of the barbell bar holder are configured to hold the protruding section of the barbell bar, so as to hold the barbell bar and to prevent it from loosening and falling off.

13. The base includes two outwardly-expanding feet. The two outwardly-expanding feet are expanded from the rear poles toward the front poles, the distance between the two rear poles in the X direction gradually increases from the upper frame toward the base, and the distance between the rear pole and the front pole in the Y direction gradually increases from the upper frame toward the base, thereby increasing the bottom area of the base and enhancing the stability of the Smith machine greatly.

DESCRIPTION OF THE PREFERRED EMBODIMENTS

Embodiments of the present invention will now be described, by way of example only, with reference to the accompanying drawings.

Figure 1:
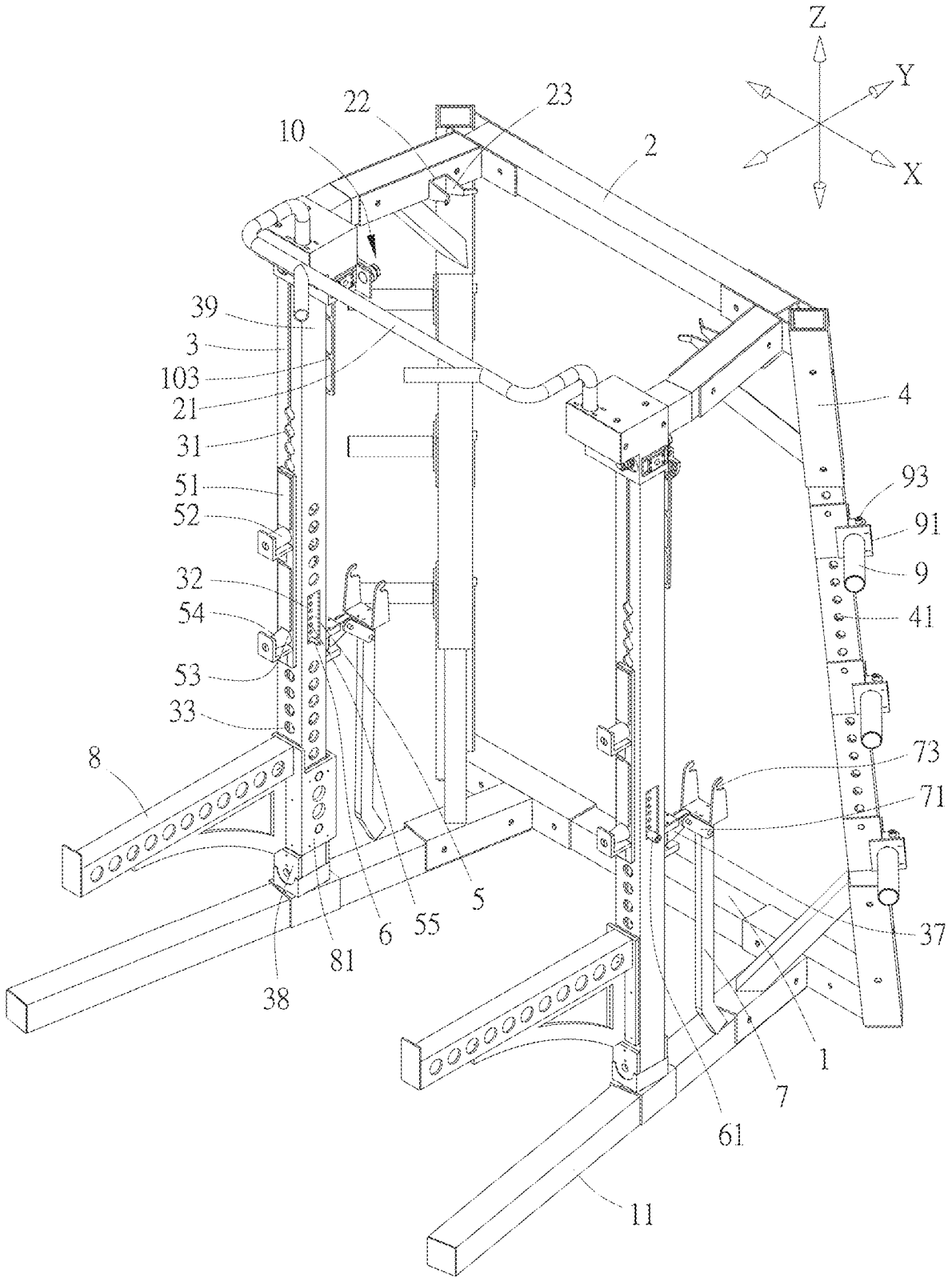
FIG. 1 is a perspective view according to a preferred embodiment of the present invention.
Figure 2:
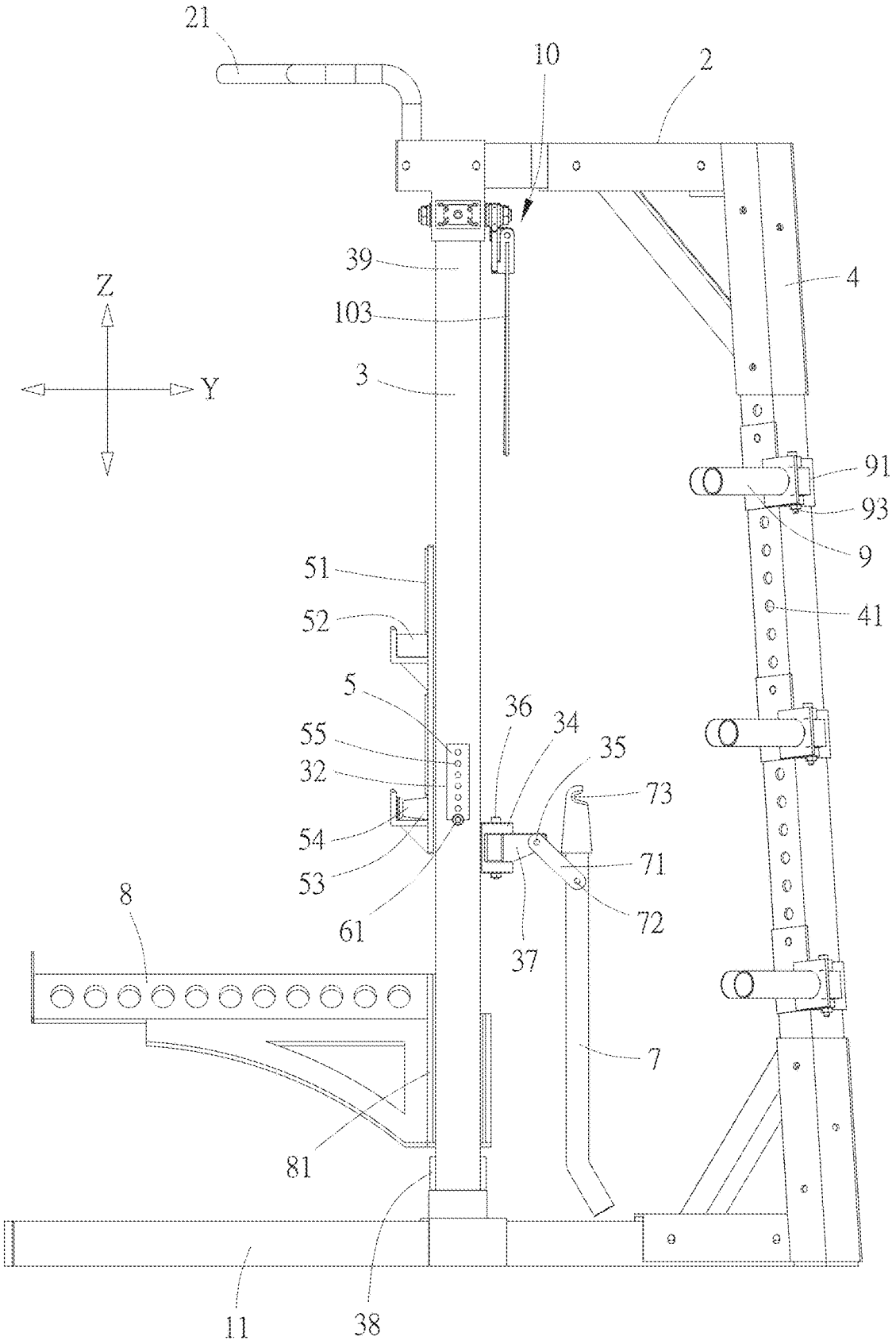
FIG. 2 is a side view according to the preferred embodiment of the present invention.

As shown in FIG. 1 and FIG. 2, an angle-adjustable Smith machine according to a preferred embodiment of the present invention comprises a base 1, an upper frame 2, two front poles 3, two rear poles 4, two movable poles 5, a plurality of positioning pins 6, two force-applying rods 7, two safety racks 8, and at least one weight disk holder 9, and at least one angle adjustment unit 10.

The base 1 includes two outwardly-expanding feet 11. The two outwardly-expanding feet 11 are expanded from the rear poles 4 toward the front poles 3, thereby increasing the bottom area of the base 1 and enhancing the stability of the Smith machine greatly.

The upper frame 2 is located at a height from the base 1 in a z direction. The upper frame 2 includes a pull-up bar 21.

The pull-up bar 21 is straddled between the front poles 3. The upper frame 2 further includes a barbell bar holder 22. The barbell bar holder 22 includes two holding pieces 23. The spacing between the two holding pieces 23 is less than a protruding section of a barbell bar. The upper frame 2 includes at least one slide slot bracket 24. The slide slot bracket 24 has a slide slot 241 in the X direction. This embodiment of the present invention has two slide slot brackets 24. The two slide slot brackets 24 each have the slide slot 241 in the X direction.

The two front poles 3 are spaced apart from each other in an X direction. The two front poles 3 extend in the Z direction and are connected between the base 1 and the upper frame 2. The two front poles 3 are hollow square poles and each have a slide groove 31 and a stop groove 32 in the Z direction. The slide groove 31 and the stop groove 32 are located on different sides of the front pole 3. A plurality of safety rack positioning holes 33 are formed on two adjacent sides of the front pole 3 in the Z direction and are located close to the base 1. The front pole 3 includes a shaft holder 34 and a first pivot shaft 35 on the shaft holder 34. The shaft holder 34 has a rotary shaft 36 parallel to the Z direction. A rotary seat 37 is pivotally connected to the rotary shaft 36. The rotary seat 37 has an extension end pivotally connected to the first pivot shaft 35. The first pivot shaft 35 is perpendicular to the rotary shaft 36. At least one of the front poles 3 has a bottom end 38 pivotally connected to the base 1 and a top end 39 coupled to the slide slot bracket 24. In this embodiment of the present invention, the bottom ends 38 of the two front poles 3 are pivotally connected to the base 1. The top ends 39 of the two front poles 3 are coupled to the slide slot brackets 24, respectively.

The two rear poles 4 are spaced apart from each other in the X direction. The two rear poles 4 are located at a distance away from the two front poles 3 in a Y direction. The two rear poles 4 extend in the Z direction and are connected between the base 1 and the upper frame 2. The X direction, the Y direction and the Z direction are perpendicular to one another. The two rear poles 4 are disposed obliquely in the Z direction. The distance between the two rear poles 4 in the X direction gradually increases from the upper frame 2 toward the base 1. The distance between the rear pole 4 and the front pole 3 in the Y direction also gradually increases from the upper frame 2 toward the base 1. The front poles 3 are parallel to the Z direction. The rear pole 4 has a plurality of weight disk holder positioning holes 41 arranged in a lengthwise direction of the rear pole.

Figure 3:
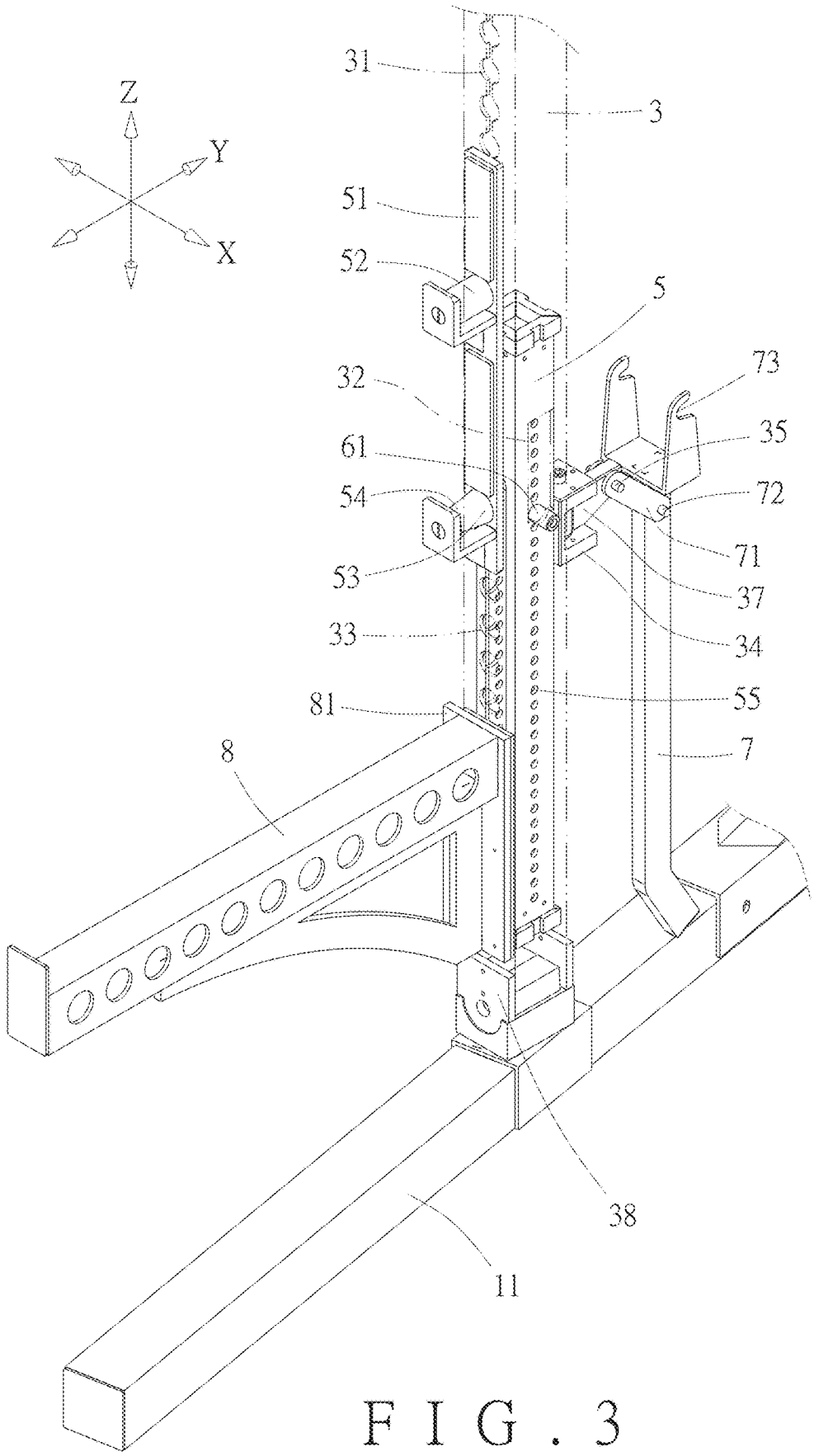
FIG. 3 is a partial enlarged view of the assembly of the front pole and the movable pole according to the preferred embodiment of the present invention.
Figure 4:
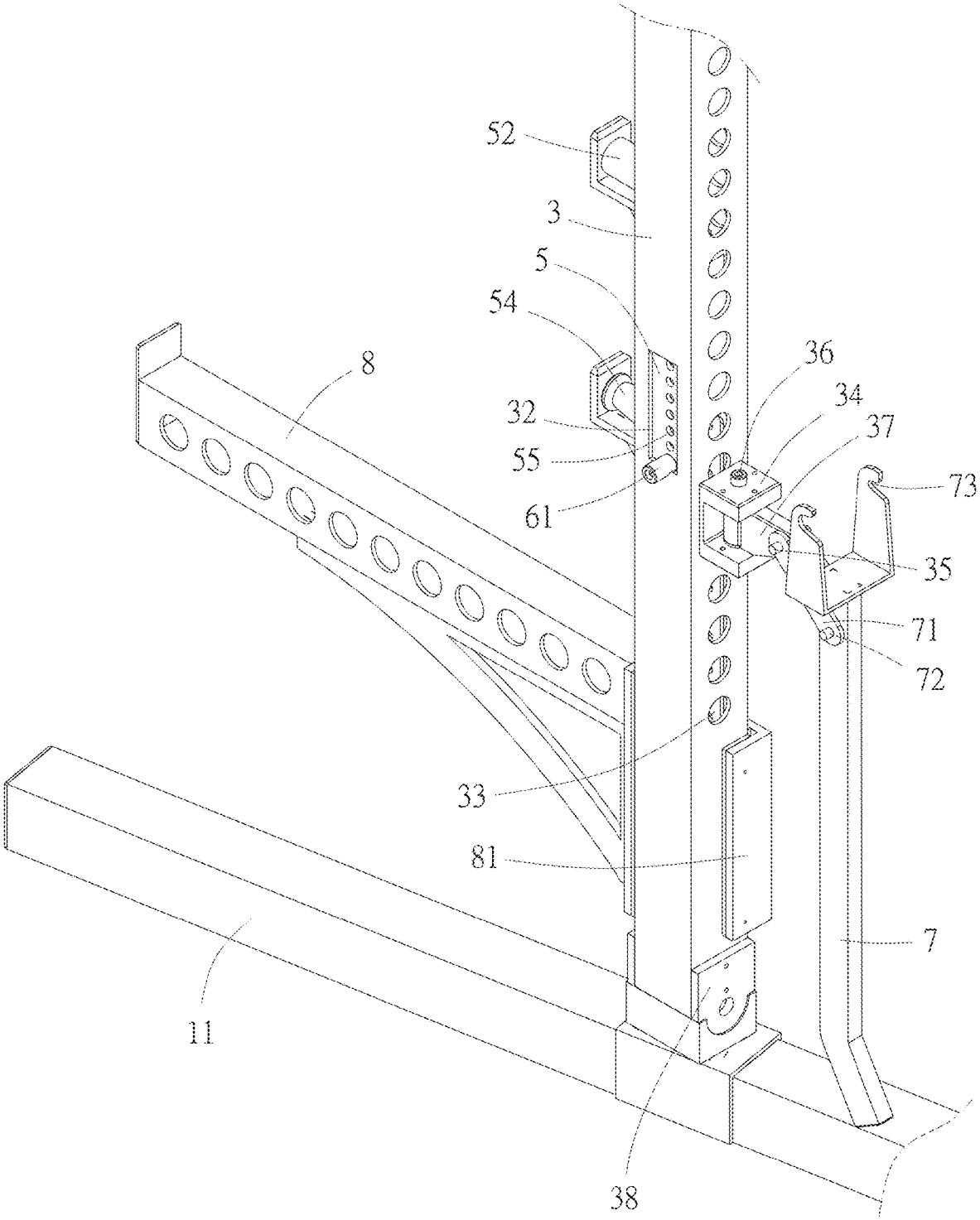
FIG. 4 is another partial enlarged view of the assembly of the front pole and the movable pole according to the preferred embodiment of the present invention.
Figure 5:
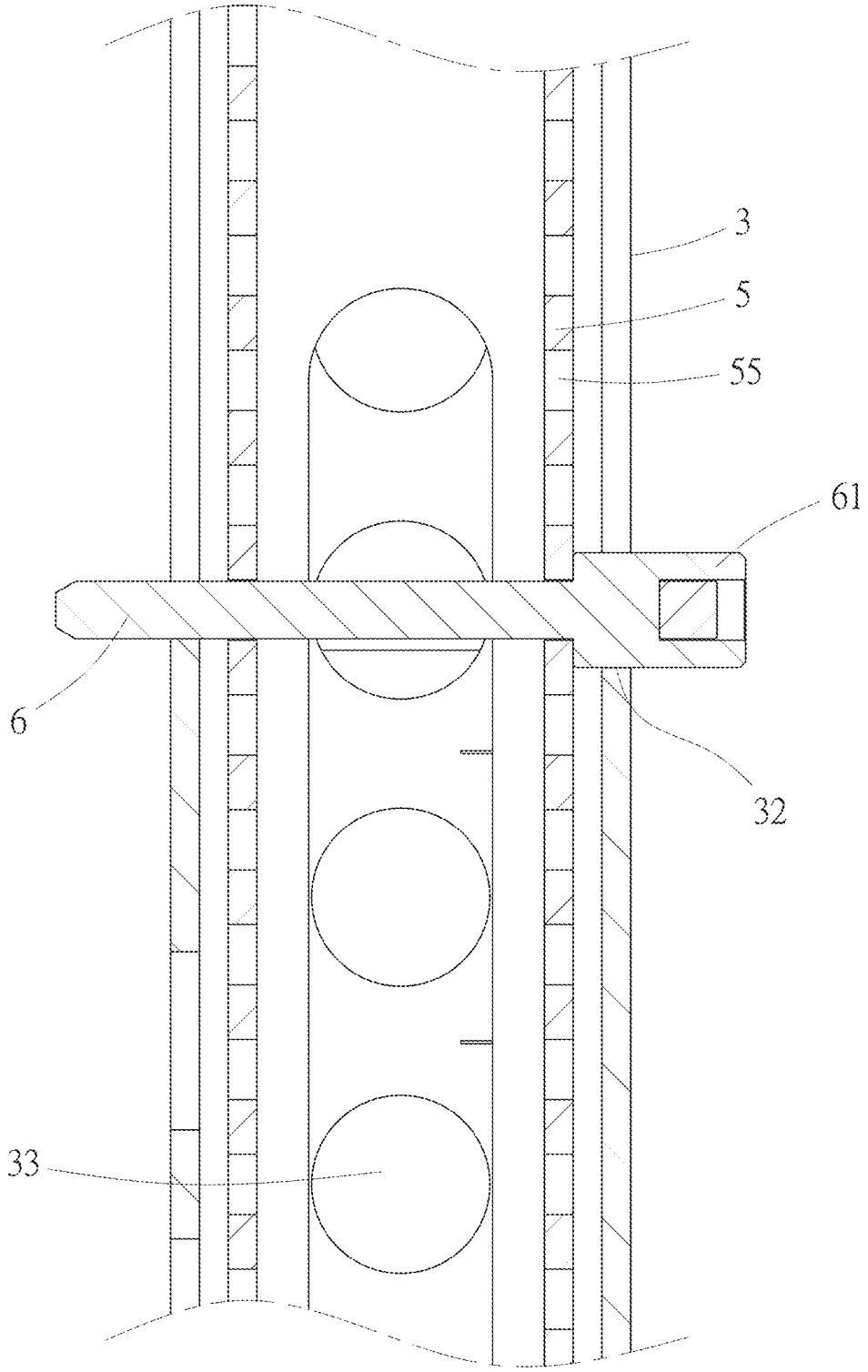
FIG. 5 is a schematic view of the positioning pin inserted in the positioning hole and resting against the lower end of the stop groove according to the preferred embodiment of the present invention.

As shown in FIG. 3, FIG. 4 and FIG. 5, the two movable poles 5 are slidably inserted in the two front poles 3 in the Z direction, respectively. The two movable poles 5 each include at least one barbell holder 51. In this embodiment of the present invention, the two movable poles 5 each include two barbell holders 51 in the Z direction. The two barbell holders 51 are defined as an upper barbell holder and a lower barbell holder. The upper barbell holder 51 is located away from the base 1 and has an upper roller 52. The upper roller 52 is a cylindrical roller. The axis of the upper roller 52 is parallel to the Y direction. The lower barbell holder 51 is located close to the base 1 and has a lower roller 53. The axis of the lower roller 53 is parallel to the Y direction. The circumference of the lower roller 53 has a recessed portion 54 in the Y direction. When in use, the barbell bar can be straddled between the recessed portions 54 of the lower rollers 53 of the two movable poles 5. When the barbell is lifted for bench press exercise, the barbell bar can be quickly disengaged from the recessed portions 54. The barbell holders 51 are exposed on the front poles 3. The two movable poles 5 each have a plurality of positioning holes 55 arranged in the Z direction and corresponding in position to the stop groove 32.

The positioning pins 6 are selectively inserted in the positioning holes 55. This embodiment of the present invention has at least two positioning pins 6. Each positioning pin 6 has an exposed portion 61. The exposed portion 61 resists against the lower end of the stop groove 32.

The two force-applying rods 7 are pivotally connected to the respective front poles 3. The two force-applying rods 7 are movable to support the exposed portions 61 of the respective positioning pins 6. Through leverage, the movable pole 5 can be moved up or down with less effort to relocate the positioning pin 6. By inserting the two positioning pins 6 in different positioning holes 55, the positons of the barbell holders 51 can be adjusted in the Z direction. The two force-applying rods 7 each have a connecting plate 71. One end of the connecting plate 71 is pivotally connected to the first pivot shaft 35, and the other end of the connecting plate 71 is pivotally connected to the force-applying rod 7 through a second pivot shaft 72. The force-applying rod 7 has a hook portion 73 extending forward from the second pivot shaft 72. The force-applying rod 7 is swingable between the front pole 3 and the rear pole 4 through the rotary seat 37 with the rotary shaft 36 as the axis.

Figure 6:
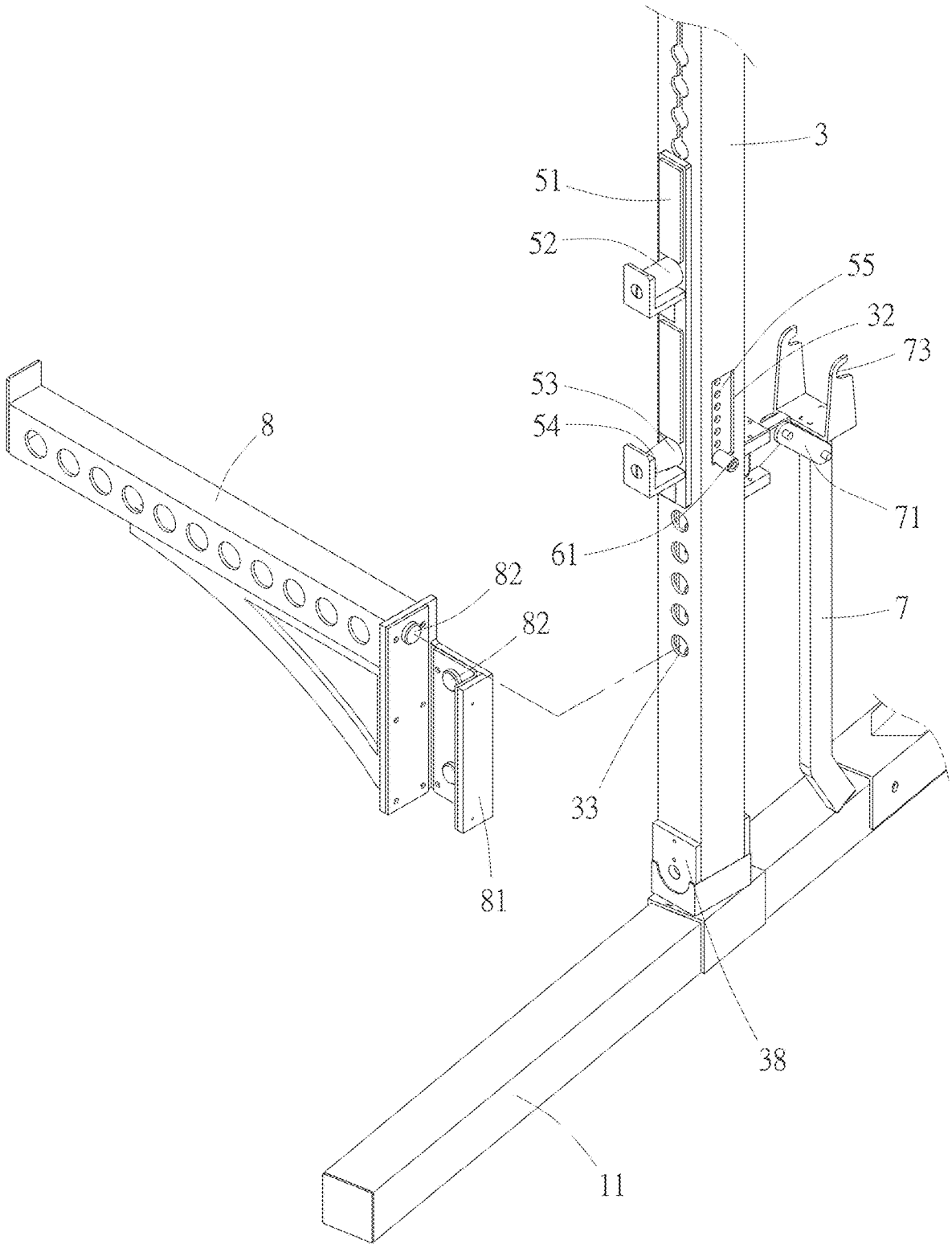
FIG. 6 is an exploded schematic view of the safety rack and the front pole according to the preferred embodiment of the present invention.
Figure 7:
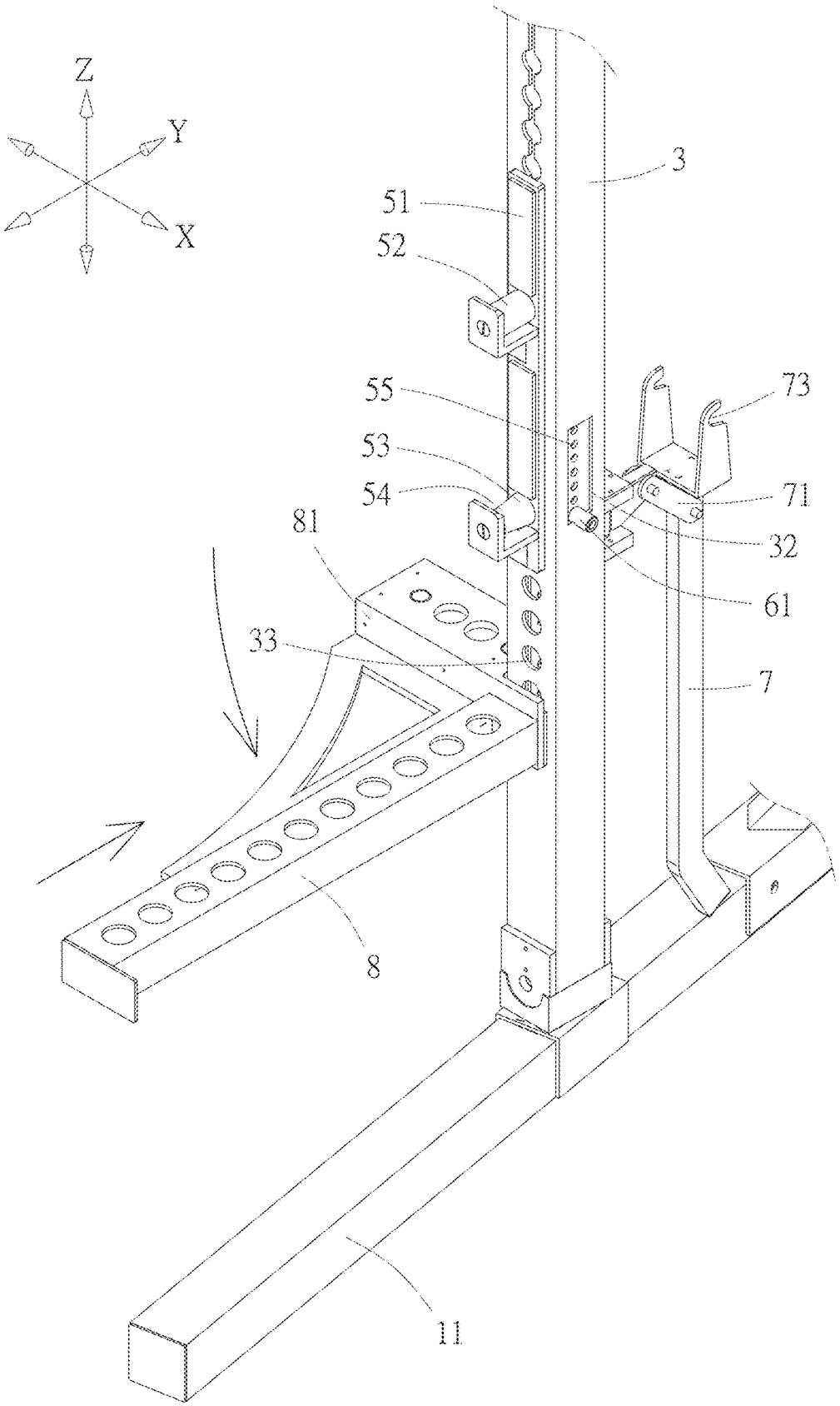
FIG. 7 is a schematic view of the safety rack horizontally coupled to the front pole according to the preferred embodiment of the present invention.
Figure 8:
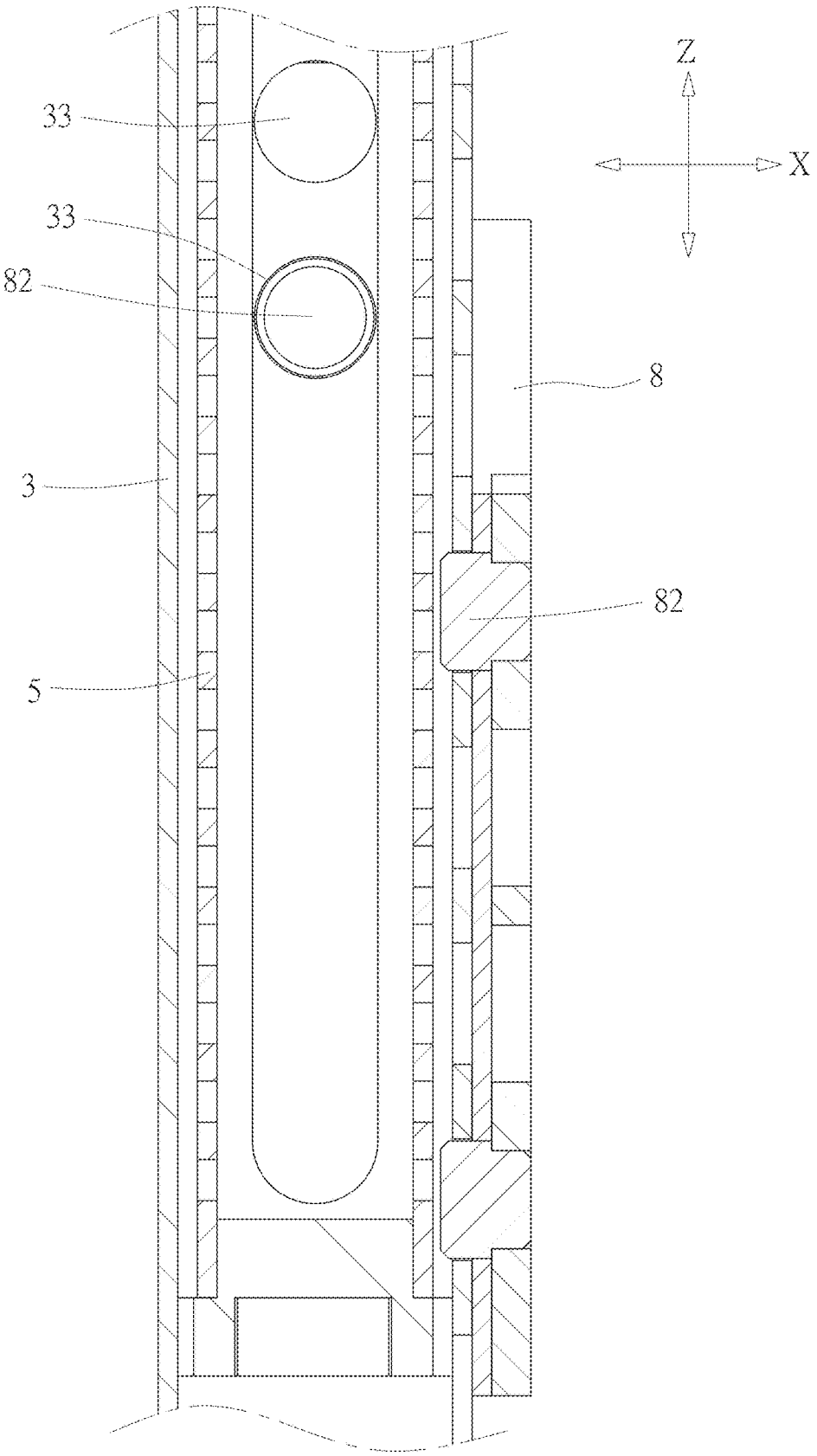
FIG. 8 is a sectional view of the safety rack vertically coupled to the front pole according to the preferred embodiment of the present invention.

As shown in FIG. 6, FIG. 7 and FIG. 8, the two safety racks 8 each have a U-shaped mount 81 corresponding to the safety rack positioning holes 33. The inner wall of the U-shaped mount 81 has protrusions 82. The protrusions 82 are selectively engaged in the safety rack positioning holes 33 from different planes, so that the U-shaped mount 81 surrounds the front pole 3 and is selectively secured at different positions in the Z direction.

Figure 9:
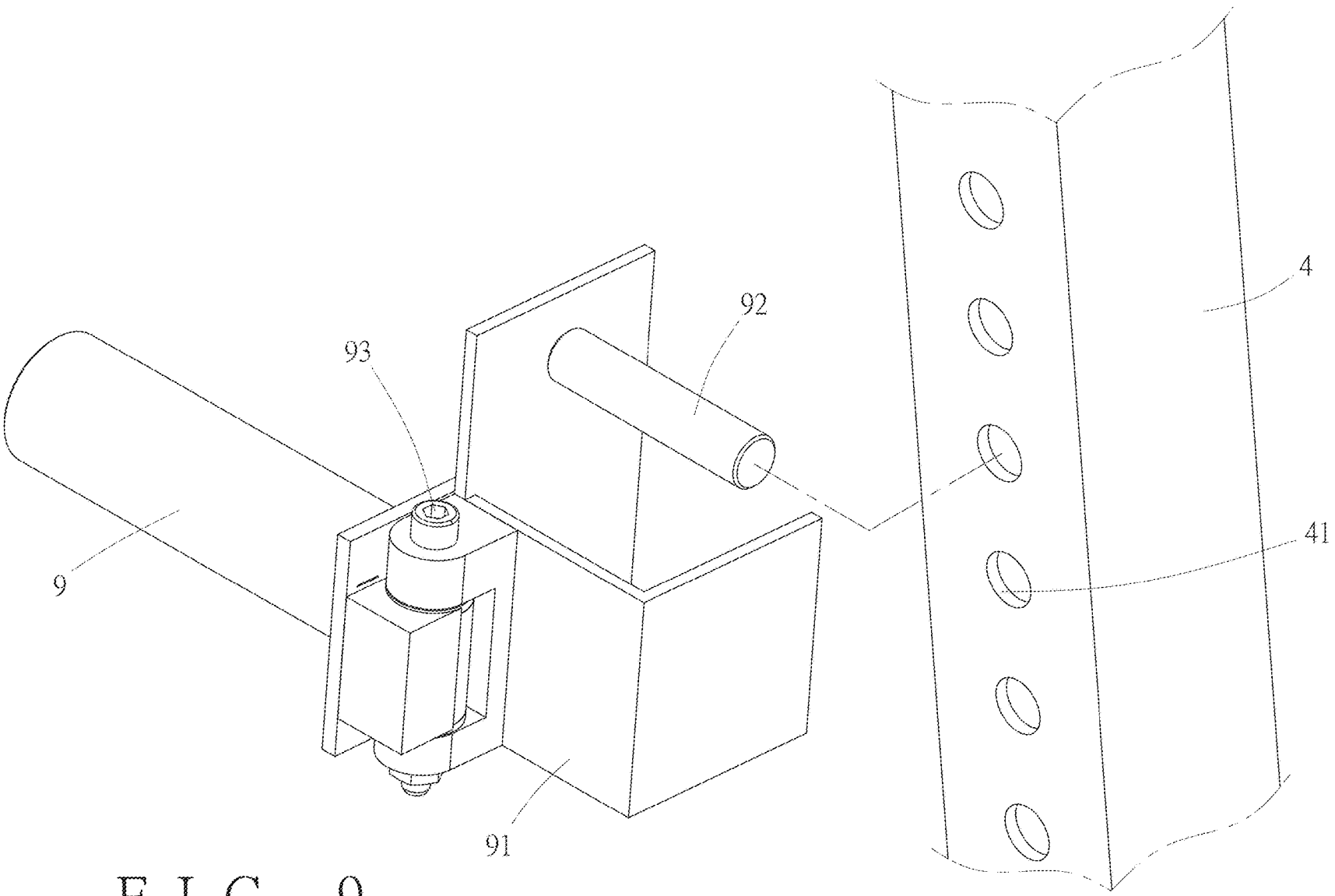
FIG. 9 is an exploded schematic view of the weight disk holder and the rear pole according to the preferred embodiment of the present invention.
Figure 10:
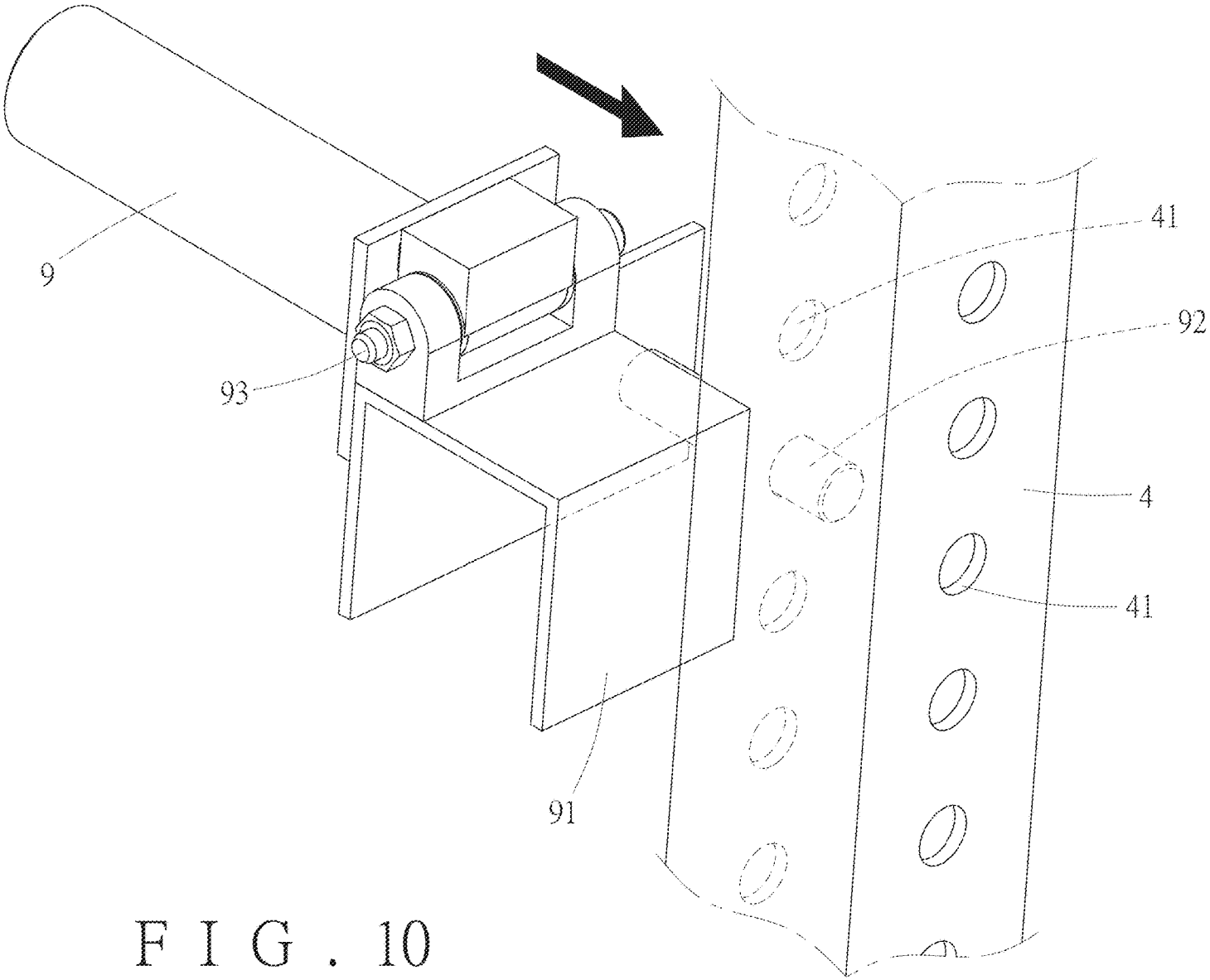
FIG. 10 is a schematic view of the weight disk holder horizontally coupled to the rear pole according to the preferred embodiment of the present invention.
Figure 11:
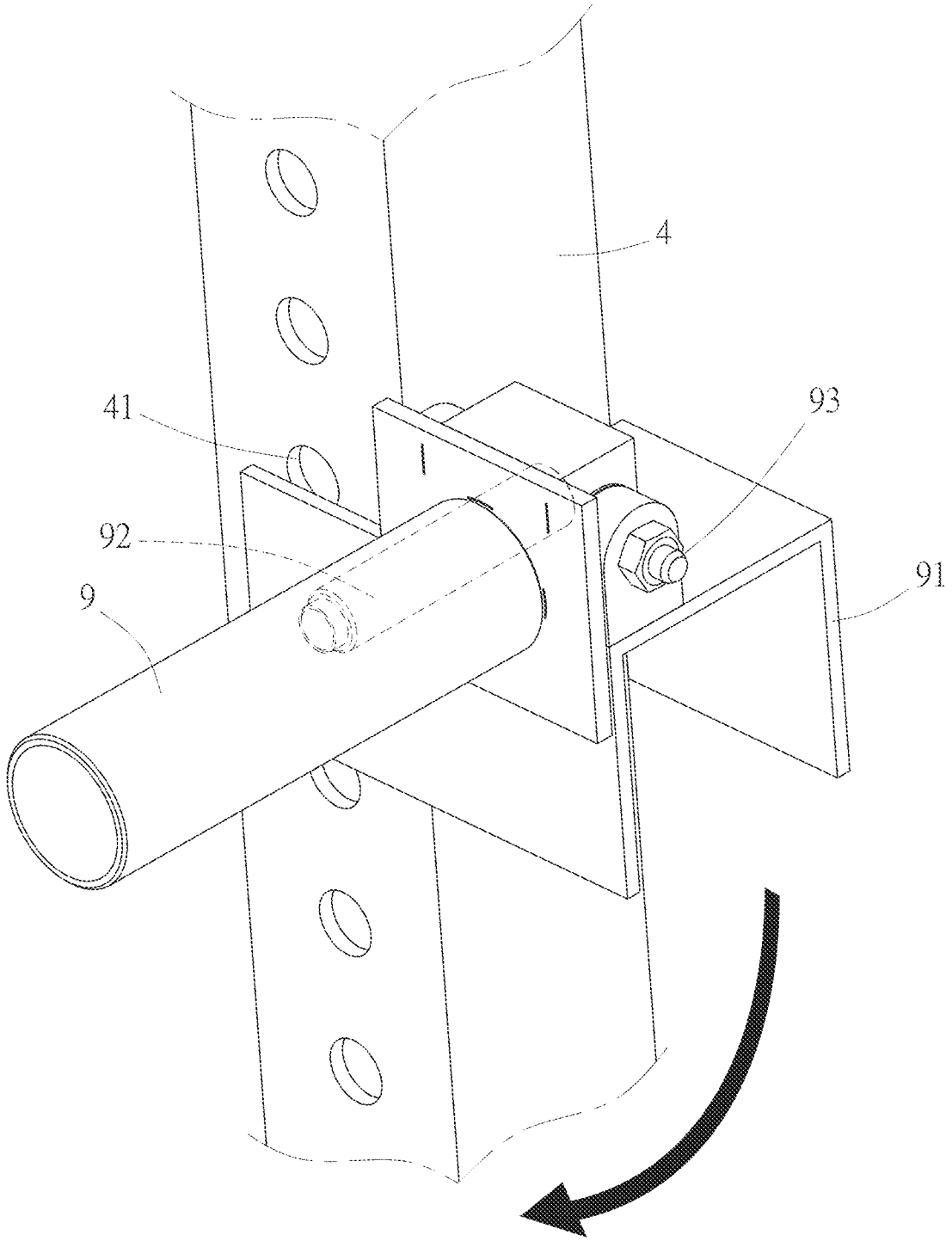
FIG. 11 is a schematic view of the weight disk holder vertically coupled to the rear pole according to the preferred embodiment of the present invention.
Figure 12:
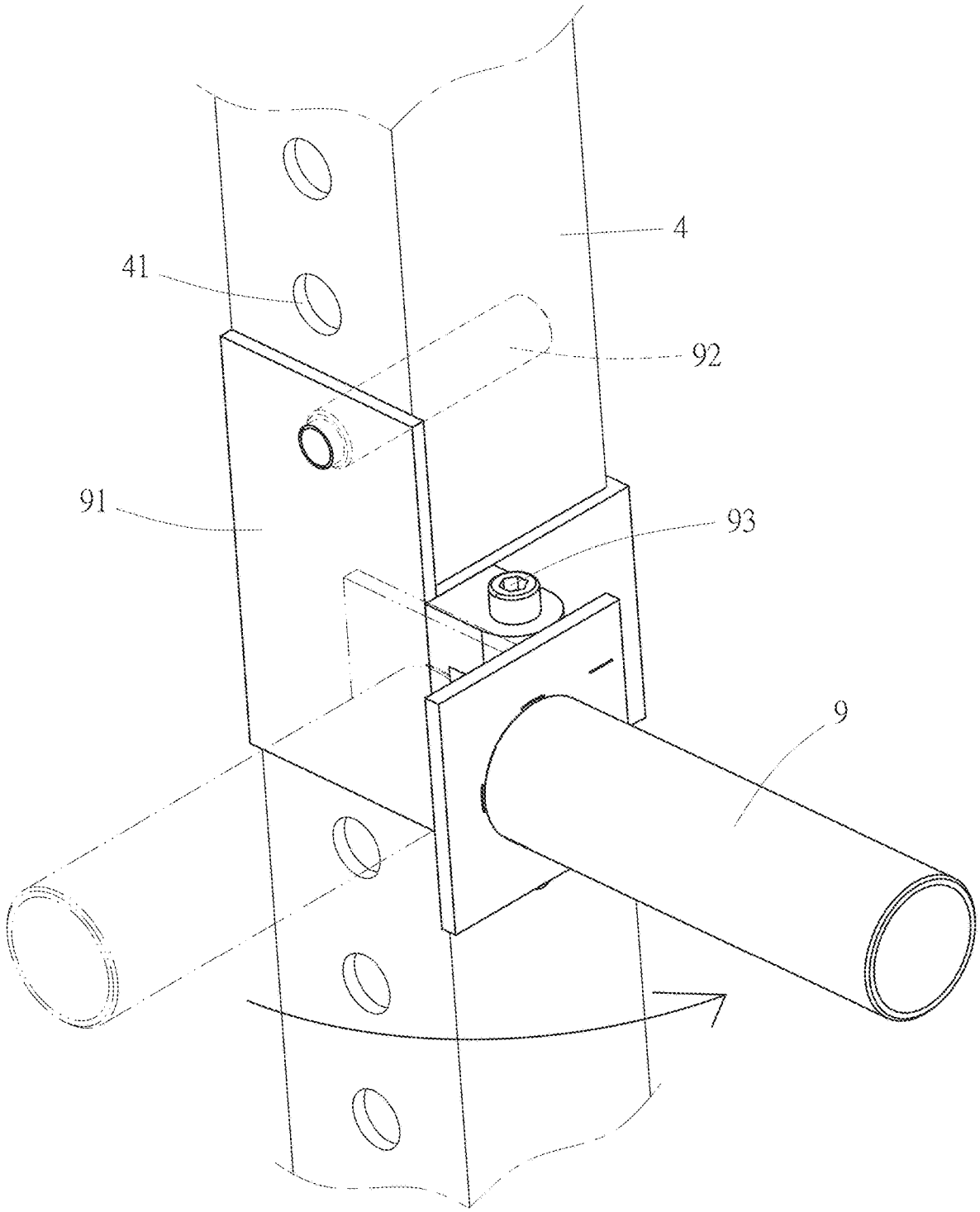
FIG. 12 is a schematic view of the weight disk holder that is rotated by 90 degrees relative to the rear pole according to the preferred embodiment of the present invention.

As shown in FIG. 9, FIG. 10 and FIG. 11, the weight disk holder 9 has a U-shaped seat 91 corresponding to the weight disk holder positioning holes 41. The inner wall of the U-shaped seat 81 has at least one protruding portion 92. The protruding portion 92 is selectively engaged in the corresponding weight disk holder positioning hole 41 from different planes, so that the U-shaped seat 91 surrounds the rear pole 4 and is selectively secured at different positions in the Z direction. As shown in FIG. 12, the weight disk holder 9 is movably pivoted to the U-shaped seat 91 through a pivot member 93. The weight disk holder 9 can be rotated by 90 degrees relative to the U-shaped seat 91 in the lengthwise direction of the rear pole 4 through the pivot member 93.

Figure 20:
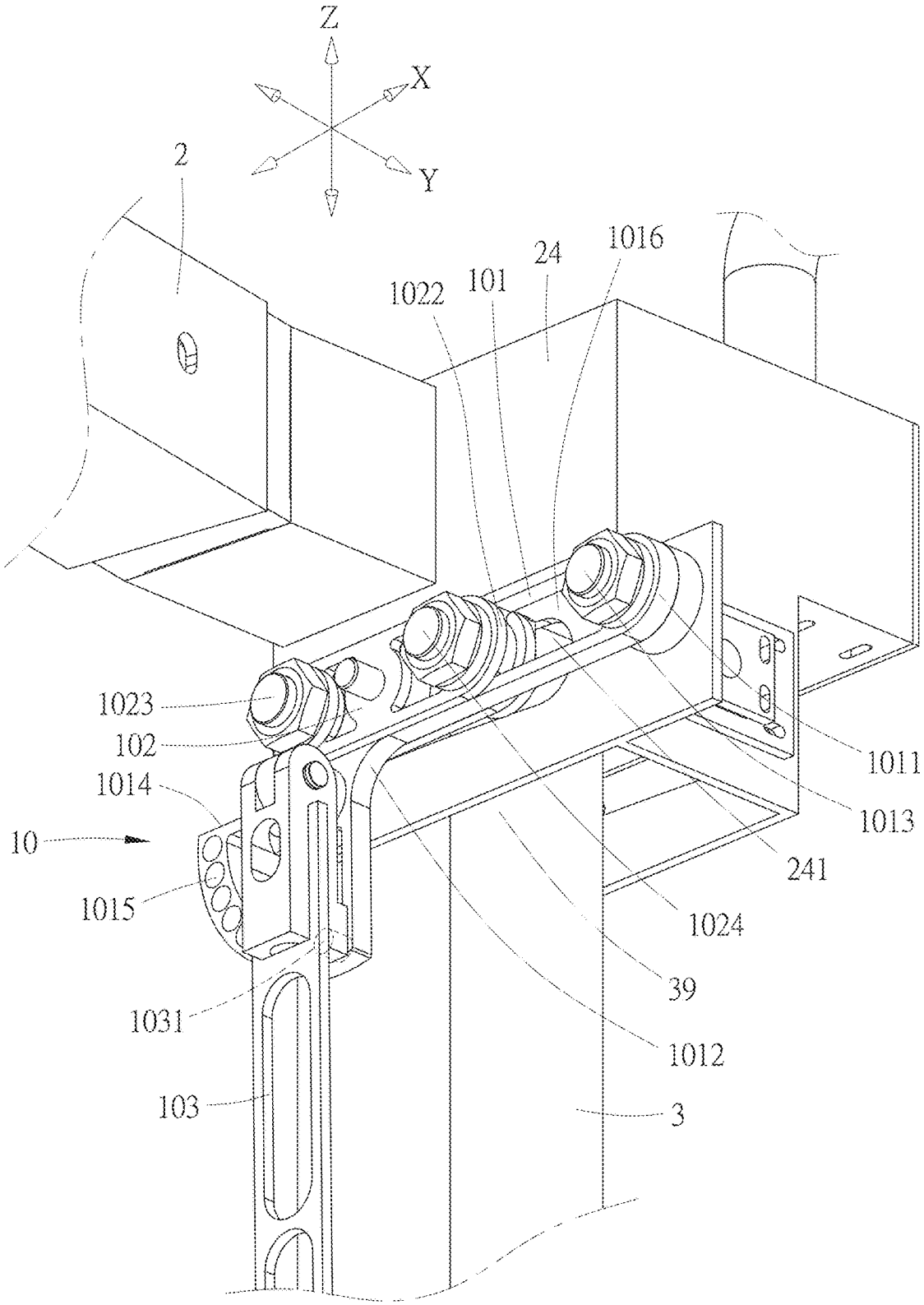
FIG. 20 is a schematic view of the angle adjustment unit according to the preferred embodiment of the present invention.
Figure 21:
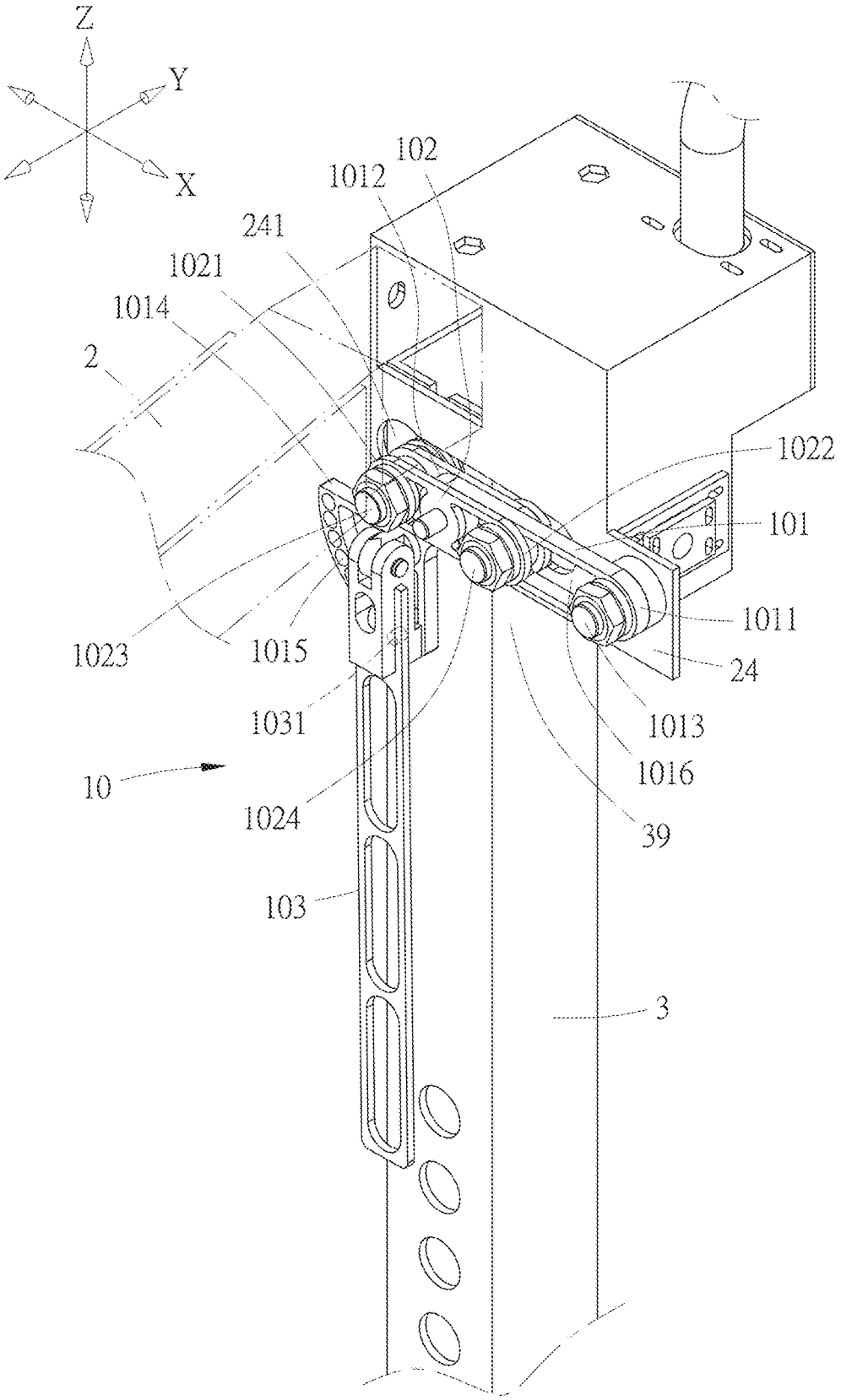
FIG. 21 is another schematic view of the angle adjustment unit according to the preferred embodiment of the present invention.

As shown in FIG. 1, FIG. 20 and FIG. 21, the embodiment of the present invention includes two angle adjustment units 10. The two angle adjustment units 10 are disposed on the two slide slot brackets 24 and connected to the top ends 39 of the front poles 3, respectively. The angle adjustment unit 10 includes a driving rod 101, a driven rod 102, and an operating handle 103. The driving rod 10 has two ends defined as a first end 1011 and a second end 1012. The first end 1011 is pivotally connected to the slide slot bracket 24 via a first shaft 1013. The second end 1012 is connected to a restricting portion 1014. The restricting portion 1014 has a plurality of positioning apertures 1015 arranged in an arc from the X direction toward the Y direction. The operating handle 103 has an appropriate length as the force arm and is pivotally connected to the restricting portion 1014. A locking member 1031 is formed on the operating handle 103. The locking member 1031 is selectively locked in one of the positioning apertures 1015. A slot 1016 is formed between the first end 1011 and the second end 1012. The driven rod 102 is composed of two plates connected to each other. The driven rod 102 has two end portions defined as a first end portion 1021 and a second end portion 1022. The first end portion 1021 is secured to the top end 39 of the front pole 3 through a second shaft 1023 passing through the slide slot 241, such that the second shaft 1023 can move within the slide slot 241 and drive the top end 39 to pivot relative to the bottom end 38. The second end portion 1022 and the second end 1012 are pivotally connected to a third shaft 1024 fixed in the slot 1016. The operating handle 103 is rotated to drive the driving rod 101 and the driven rod 102 to move relative to each other, so that the angle adjustment unit 10 drives the top end 39 to move in the X direction and then to be secured, and the bottom end 38 of the front pole 3 is pivoted in the X direction for the front pole 3 to be adjusted at a predetermined angle. The angle is 3 degrees.

When in use, as shown in FIG. 2, FIG. 3 and FIG. 11, depending on the desired weightlifting exercise, such as squat or bench press, a barbell A is selectively placed between the two upper or lower barbell holders 51 of the movable poles 5. If the barbell A is selectively placed between the two upper barbell holders 51, the barbell bar A1 of the barbell A will be placed between the two upper rollers 52, and the position of the barbell A will be adjusted left or right in the X direction through the two upper rollers 52 able to roll in the X direction, so as to facilitate the lifting of the barbell A during exercise. If the barbell A is selectively placed between the two lower barbell holders 51, the barbell bar A1 of the barbell A will be placed between the two lower rollers 53. The barbell A is placed between the two recessed portions 54 of the two lower rollers 53, so that the barbell A1 can be quickly separated from the two recessed portions 54 when the barbell A1 is lifted during bench press exercise.

Figure 14:
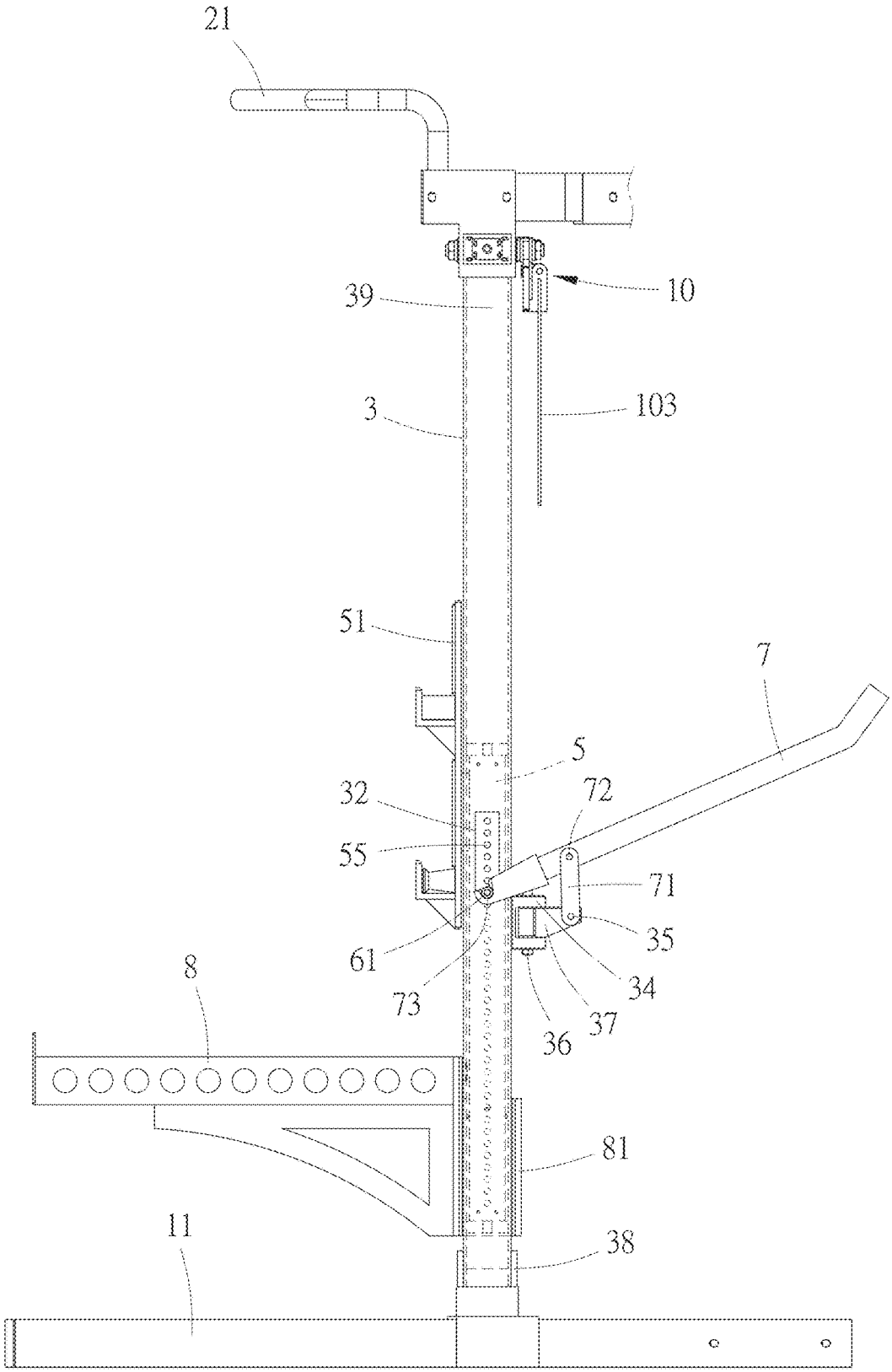
FIG. 14 is a schematic view illustrating that the hook portion of the force-applying rod is engaged with the exposed portion of the positioning pin according to the preferred embodiment of the present invention.
Figure 15:
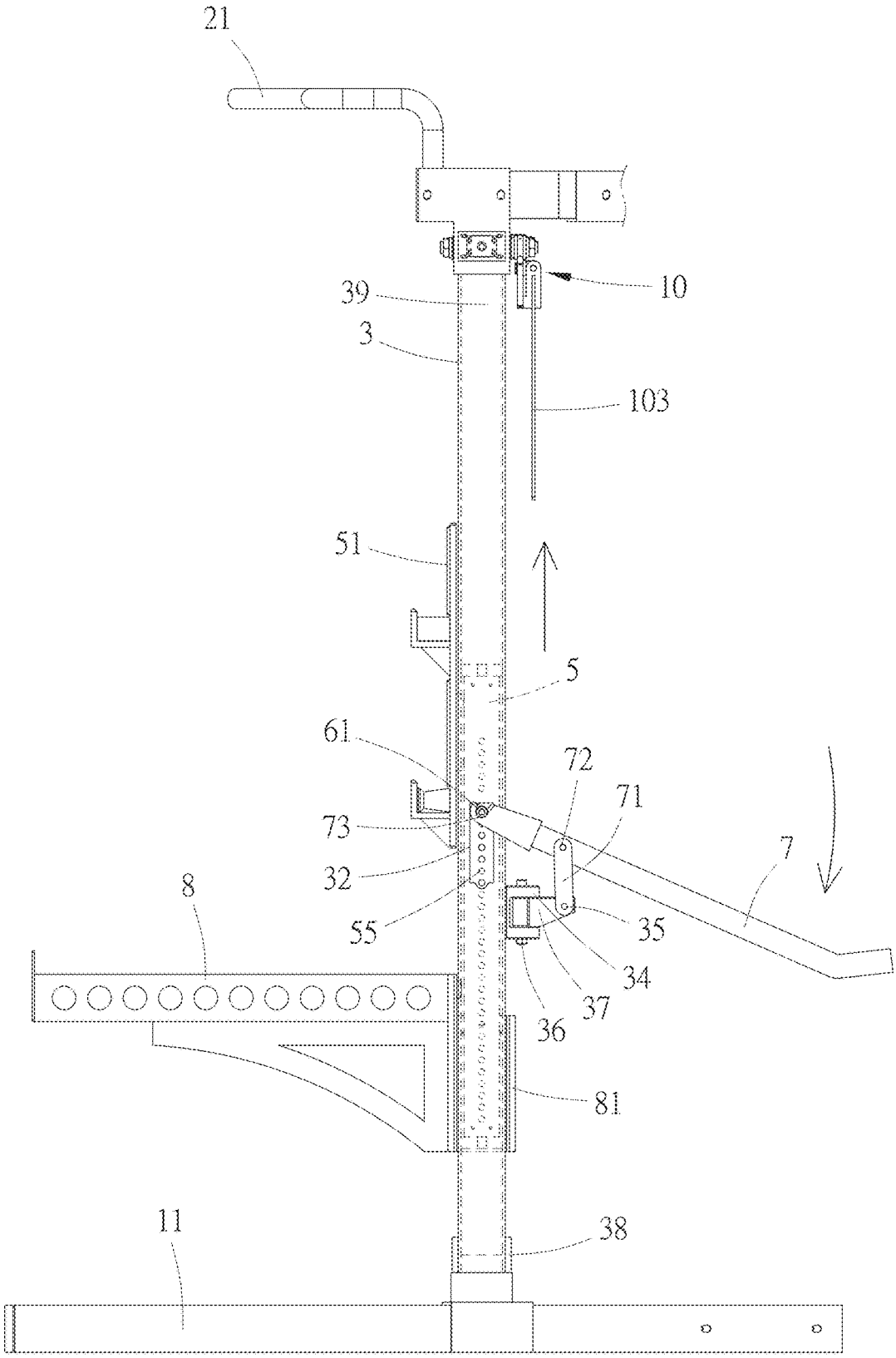
FIG. 15 is a schematic view illustrating that the movable pole is lifted by the force-applying rod according to the preferred embodiment of the present invention.
Figure 16:
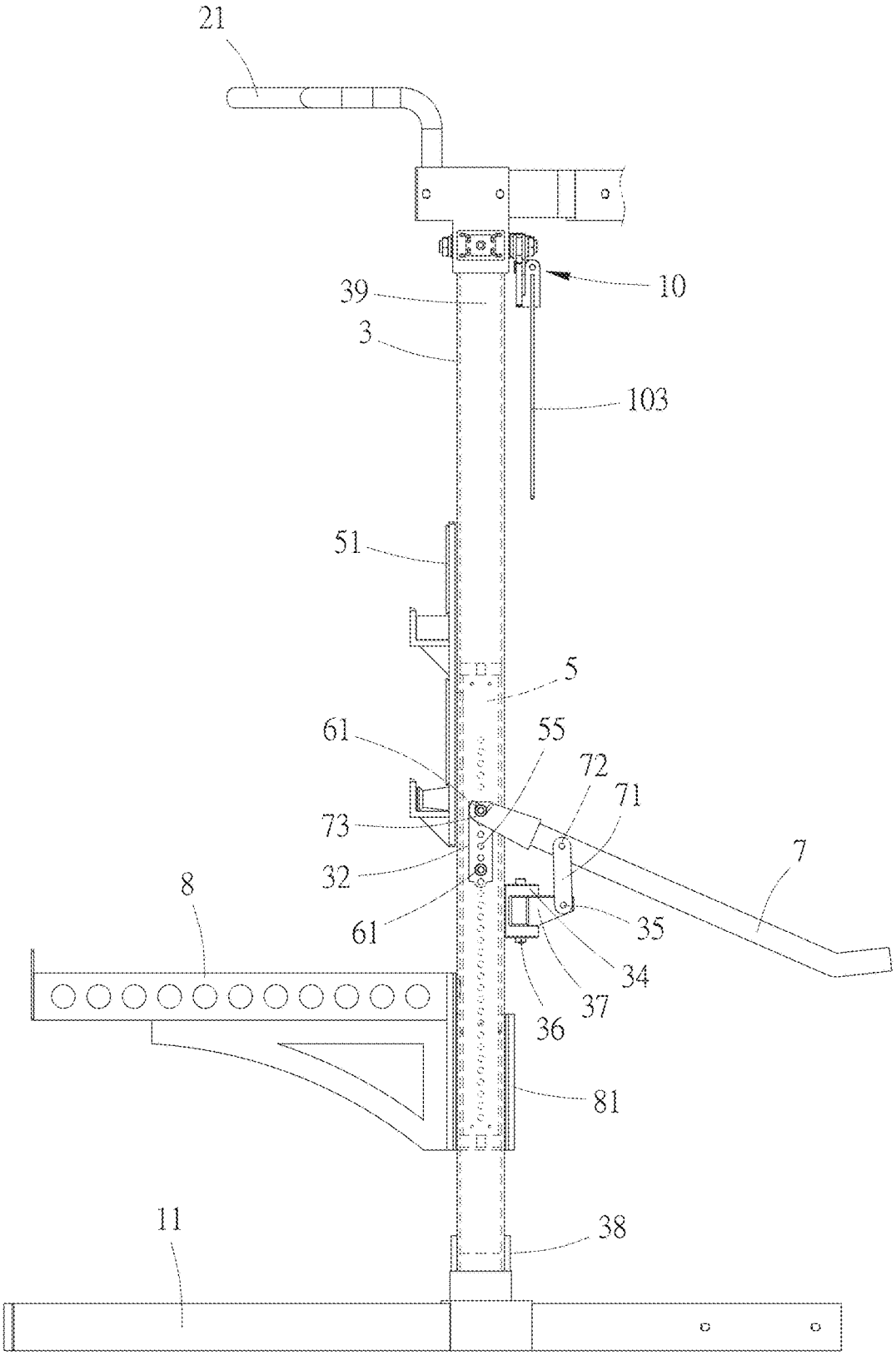
FIG. 16 is a schematic view illustrating that the other positioning pin is inserted in the positioning hole at the lowest position of the stop groove according to the preferred embodiment of the present invention.
Figure 17:
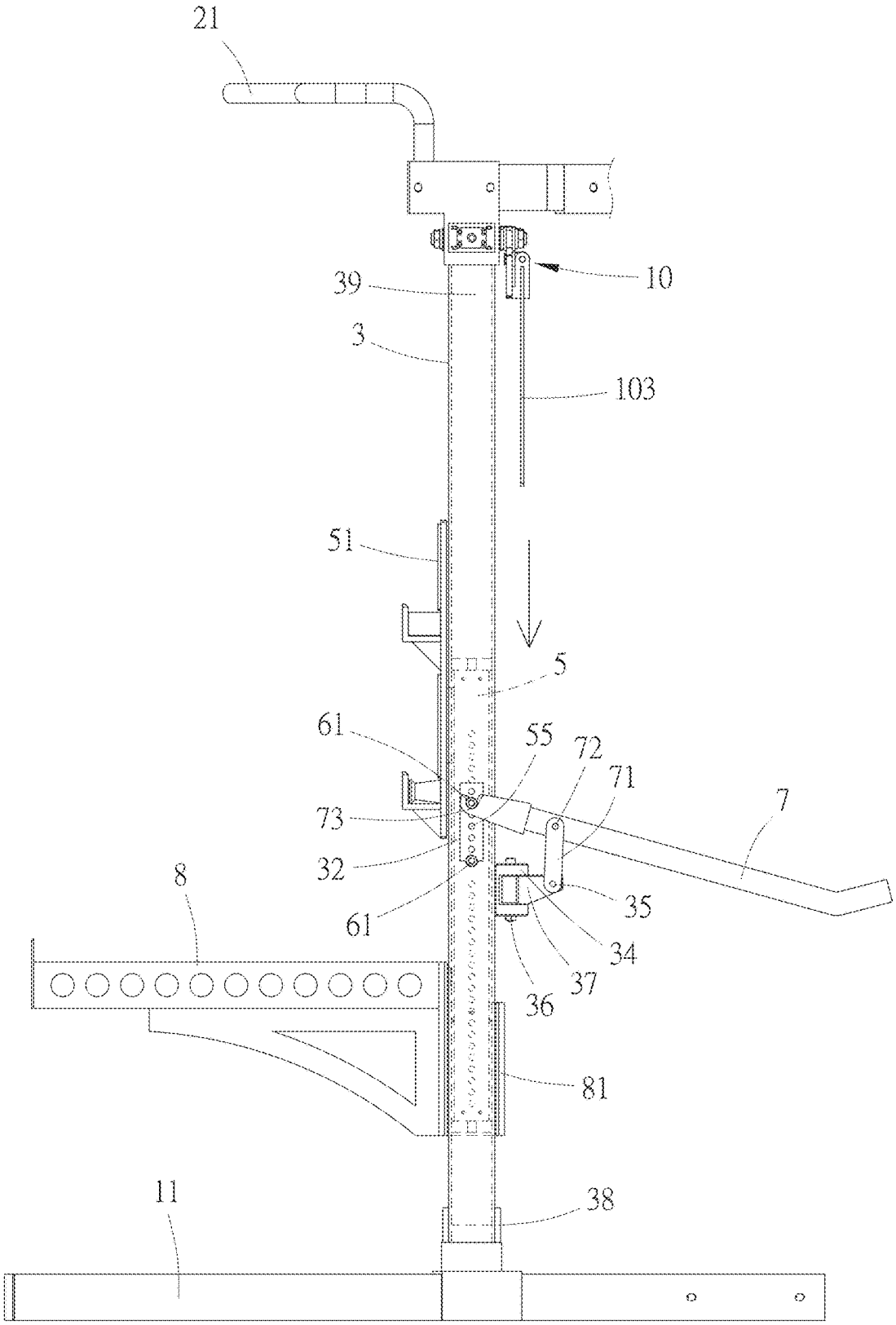
FIG. 17 is a schematic view illustrating that the force-applying rod is released and the movable pole descends according to the preferred embodiment of the present invention.
Figure 18:
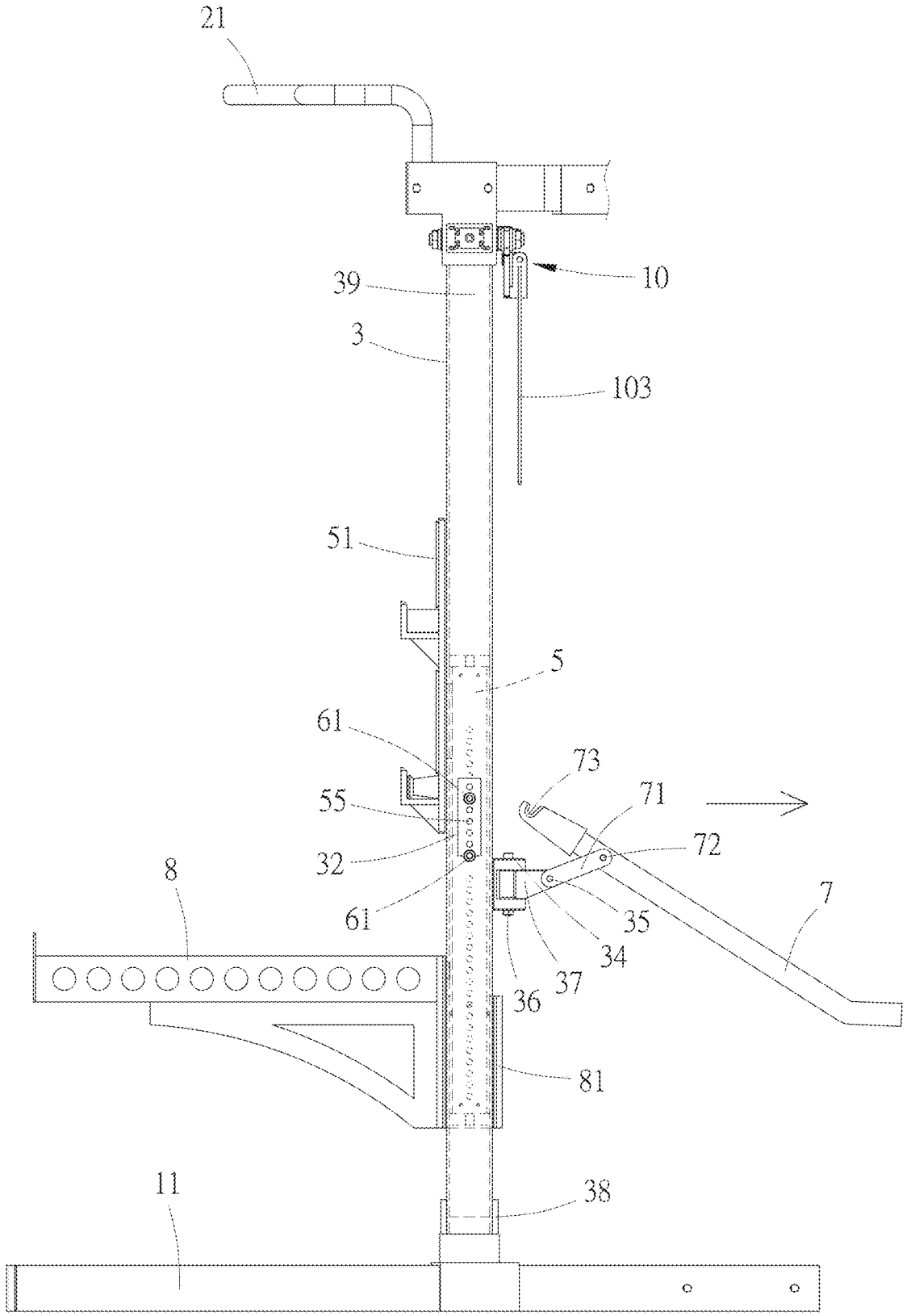
FIG. 18 is a schematic view illustrating that the hook portion of the force-applying rod is disengaged from the positioning pin according to the preferred embodiment of the present invention.

As shown in FIG. 3, FIG. 4 and FIG. 14, when it is necessary to adjust the barbell holder 51 to a different position in height of the front pole 3, the hook portion 73 of the force-applying rod 7 is moved to hook the exposed portion 61 of the positioning pin 6 that is inserted in the movable pole 5 and rests against the lower end of the stop groove 32. As shown in FIG. 15, the force-applying rod 7 is supported by the first pivot shaft 35 and the connecting plate 71, and then the force-applying rod 7 is pressed downward with the second pivot shaft 72 as a fulcrum. Through leverage, the exposed portion 61 and the positioning pin 6 are pushed upward, and the positioning pin 6 lifts the movable pole 5 upward in the Z direction relative to the front pole 3. As shown in FIG. 16, the other positioning pin 6 is inserted in the positioning hole 55 at the lowest position of the stop groove 32. As shown in FIG. 17, the force-applying rod 7 is released, allowing the movable pole 5 to descend by gravity. The exposed portion 61 of the other positioning pin 6 rests against the lower end of the stop groove 32, so that the lifted movable pole 5 can be elevated and secured relative to the front pole 3. Then, by the same operation as described above, the two positioning pins are relocated up and down in turns, such that the movable pole 5 can be elevated to the desired height. Finally, as shown in FIG. 18, the hook portion 73 of the force-applying rod 7 is separated from the exposed portion 61 of the positioning pin 6 located at the upper position of the stop groove 32, and the force-applying rod 7 is moved to its original position. In the same way, the force-applying rod 7 on the other side can elevate the corresponding movable pole 5. The movable poles 5 on both sides can be elevated to the same height relative to the two front poles 3, so that the barbell holders 51 can be quickly adjusted to different heights with less effort. If the movable poles 5 are to be lowered, the above operation can be reversed. The other positioning pin 6 is inserted in the positioning hole 55 located at the upper position of the stop groove 32, and then the hook portion 73 of the force-applying rod 7 is moved to hook the exposed portion 61 of the upper positioning pin 6 inserted in the movable pole 5 and the movable pole 5 is slightly lifted. After that, the lower positioning pin 6 is pulled out, and then the force-applying rod 7 is released, allowing the movable pole 5 to descend by gravity. The exposed portion 61 of the upper positioning pin 6 rests against the lower end of the stop groove 32, so that the movable pole 5 descends and is secured relative to the front pole 3. Then, by the same operation as described above, the two positioning pins are relocated up and down in turns, such that the movable pole 5 descends to the desired height.

Figure 13:
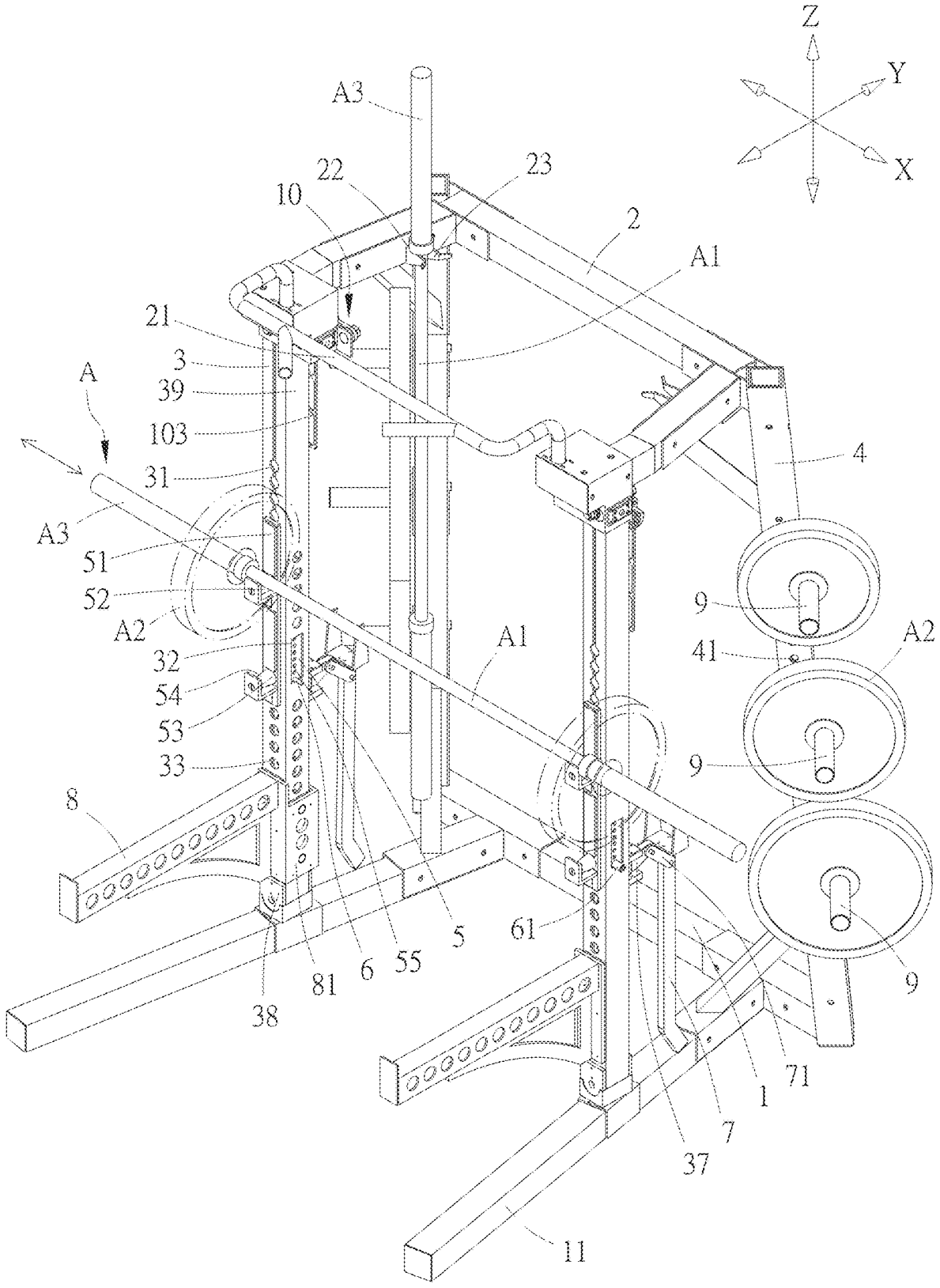
FIG. 13 is a perspective view according to the preferred embodiment of the present invention in cooperation with the barbell, the barbell bar, and the weight disks when in use.

As shown in FIG. 2 and FIG. 13, the safety racks 8 can be secured at different heights of the two front poles 3. When the barbell A slips due to an accidental mistake during the weightlifting exercise, such as bench press, the two safety racks 8 can catch the barbell A to avoid accidental injuries. As shown in FIG. 6 and FIG. 7, the safety rack 8 is adjusted in such a way that the protrusion 82 on one inner side of the U-shaped mount 81 is horizontally engaged in the corresponding safety rack positioning hole 33 of one side of the front pole 3. Then, as shown in FIG. 8, the U-shaped mount 81 is rotated by 90 degrees in the vertical direction, and the protrusion 82 on another inner side of the U-shaped mount 81 is engaged in the corresponding safety rack positioning hole 33 of another side of the front pole 3, such that the U-shaped mount 81 surrounds the front pole 3 and can be selectively secured at different heights in the Z direction. Through the protrusions 82 engaged in the corresponding safety rack positioning holes 33 and the U-shaped mount 81 surrounding three sides of the front pole 3, the safety rack 8 is positioned better and able to support a larger load, thereby ensuring safety during weightlifting exercise.

As shown in FIG. 2 and FIG. 13, the safety racks 8 can be secured at different heights of the two front poles 3. When the barbell A slips due to an accidental mistake during the weightlifting exercise, such as bench press, the two safety racks 8 can catch the barbell A to avoid accidental injuries. As shown in FIG. 6 and FIG. 7, the safety rack 8 is adjusted in such a way that the protrusion 82 on one inner side of the U-shaped mount 81 is horizontally engaged in the corresponding safety rack positioning hole 33 of one side of the front pole 3. Then, as shown in FIG. 8, the U-shaped mount 81 is rotated by 90 degrees in the vertical direction, and the protrusion 82 on another inner side of the U-shaped mount 81 is engaged in the corresponding safety rack positioning hole 33 of another side of the front pole 3, such that the U-shaped mount 81 surrounds the front pole 3 and can be selectively secured at different heights in the Z direction. Through the protrusions 82 engaged in the corresponding safety rack positioning holes 33 and the U-shaped mount 81 surrounding three sides of the front pole 3, the safety rack 8 is positioned better and able to support a larger load, thereby ensuring safety during weightlifting exercise.

As shown in FIG. 2 and FIG. 13, the disassembled weight disks A2 are hung on the weight disk holders 9. When it is necessary to adjust the weight disk holder 9 mounted on the rear pole 4 at a different height, as shown in FIG. 9 and FIG. 10, the protruding portion 92 of the U-shaped seat 91 is horizontally engaged in the corresponding weight disk holder positioning hole 41. Then, as shown in FIG. 11, the U-shaped seat 91 is rotated by 90 degrees in the vertical direction, so that the U-shaped seat 91 surrounds the rear pole 4 and can be selectively secured at a different height in the Z direction. Through the protruding portion 92 engaged in the corresponding weight disk holder positioning hole 41 and the U-shaped seat 91 surrounding three sides of the rear pole 4, the weight disk holder 9 is positioned better and able to support a larger load, thereby preventing the rear pole 4 from shaking. As shown in FIG. 12, the weight disk holder 9 can be rotated by 90 degrees in the lengthwise direction of the rear pole 4 relative to the U-shaped seat 91 through the pivot member 93, thereby changing the hanging direction of the weight disk A2. This prevents the weight disk A2 hung on the weight disk holder 9 from obstructing access to the Smith machine.

Figure 19:
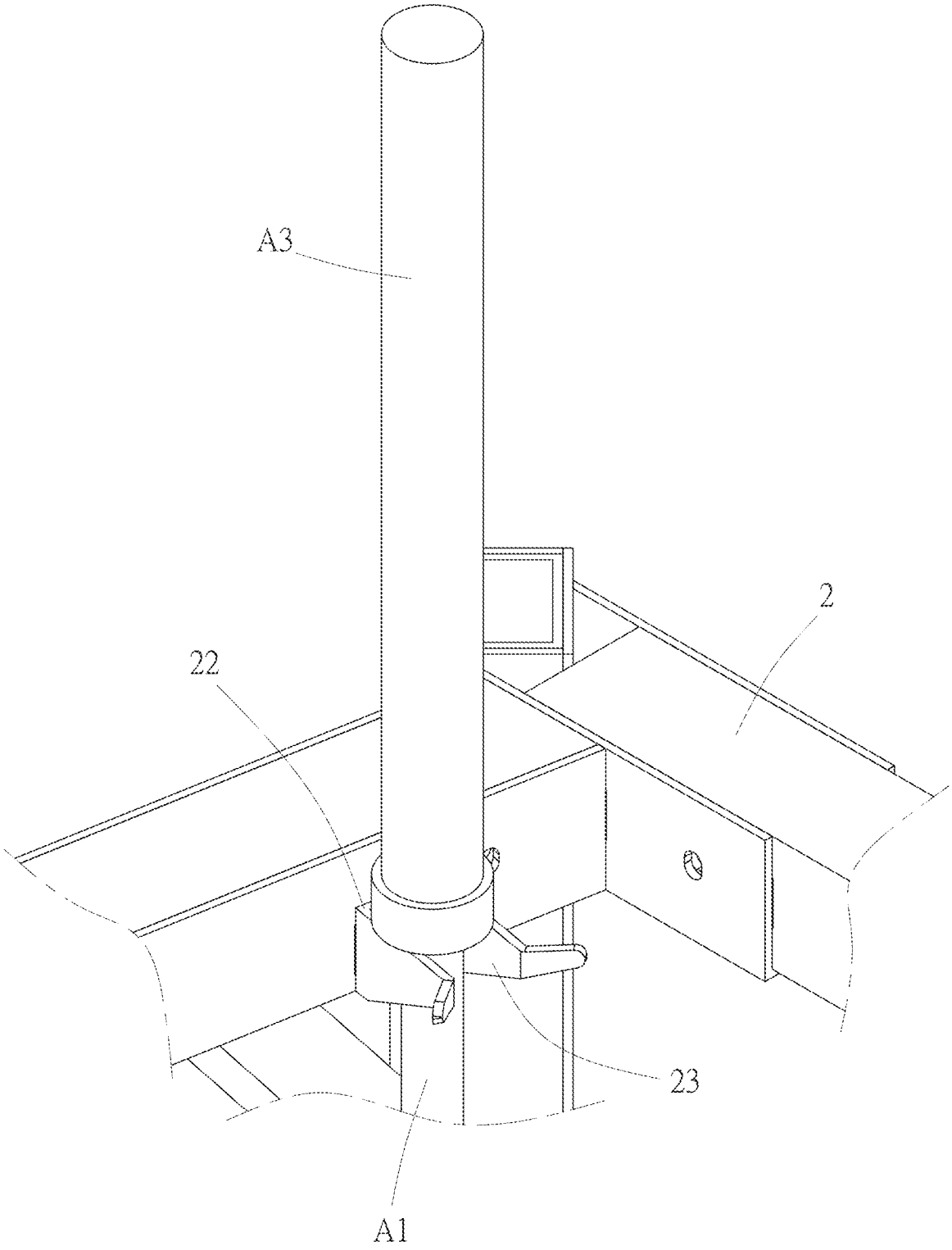
FIG. 19 is a schematic view illustrating that the barbell bar is held by the holding pieces of the barbell bar holder according to the preferred embodiment of the present invention.

As shown in FIG. 19, the disassembled barbell bar A1 can be held by the barbell bar holder 22 of the upper frame 2. The two holding pieces 23 of the barbell bar holder 22 are configured to hold the protruding section A3 of the barbell bar A1, so as to hold the barbell bar A1 and to prevent it from loosening and falling off.

Figure 22:
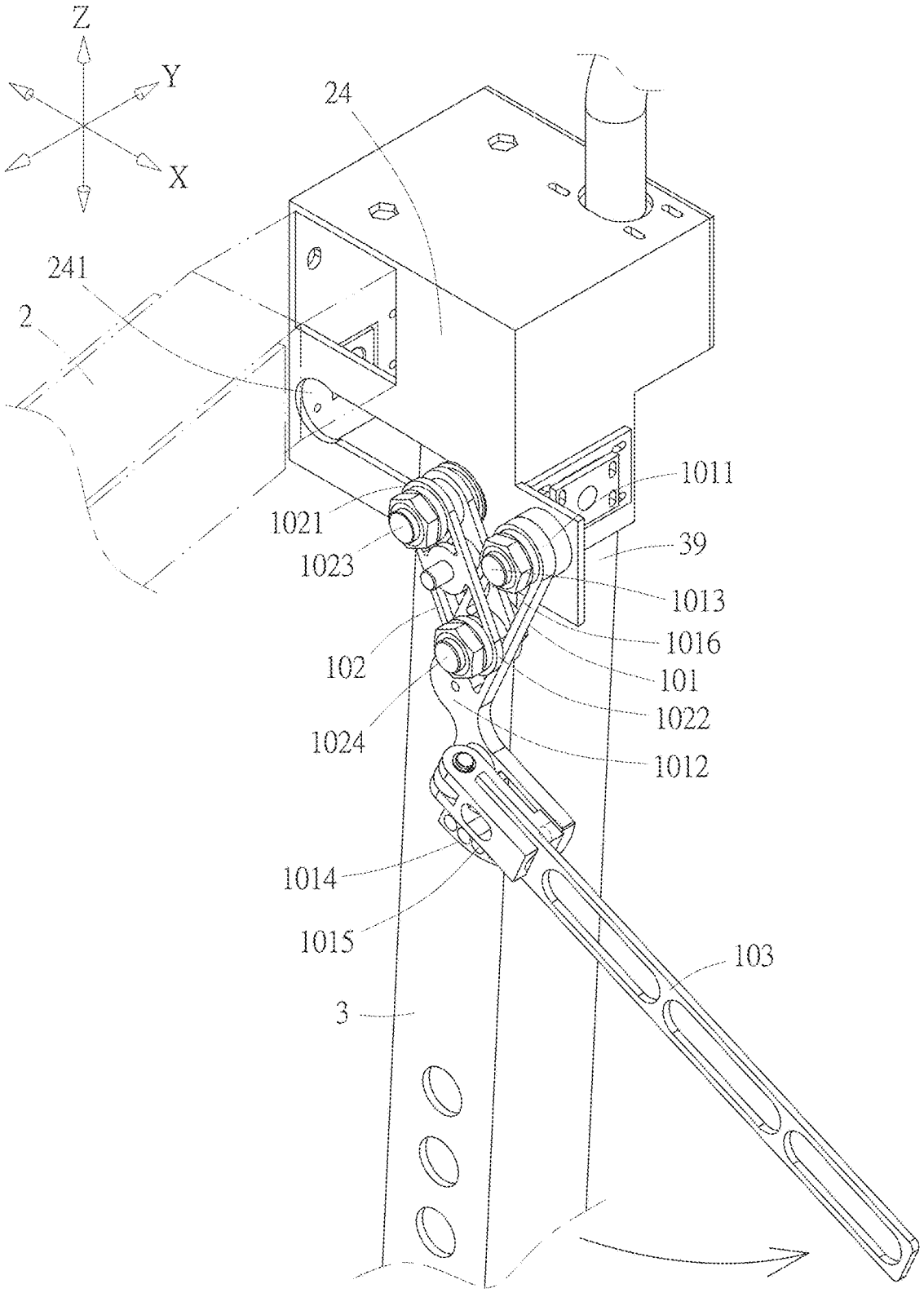
FIG. 22 is a schematic view illustrating that the driven rod is driven by the driving rod to move within the slot when the operating handle is pulled according to the preferred embodiment of the present invention.
Figure 23:
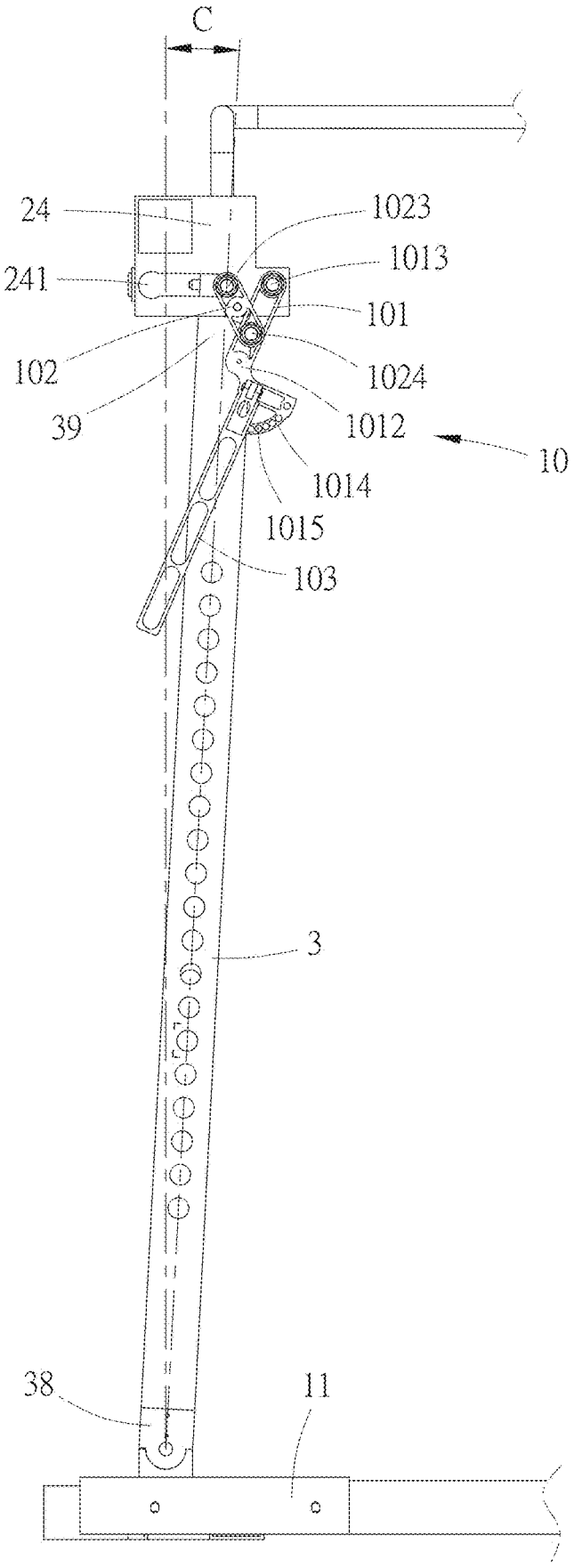
FIG. 23 is a schematic view illustrating that the top end of the front pole is pivoted by an angle with the bottom end as the pivot according to the preferred embodiment of the present invention.
Figure 24:
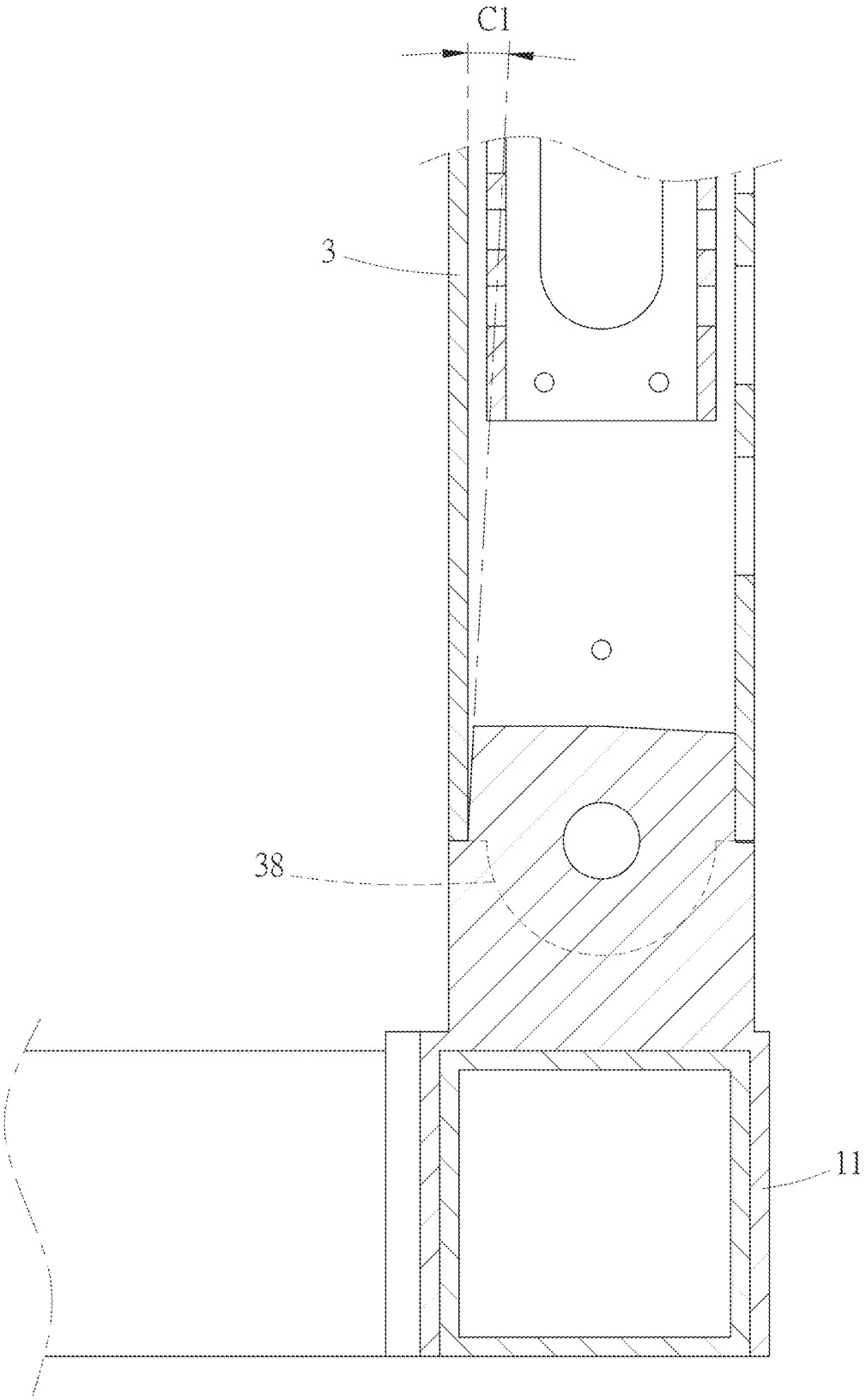
FIG. 24 is a schematic view illustrating that the front pole tilts outward at another angle before being pivoted according to the preferred embodiment of the present invention.
Figure 25:
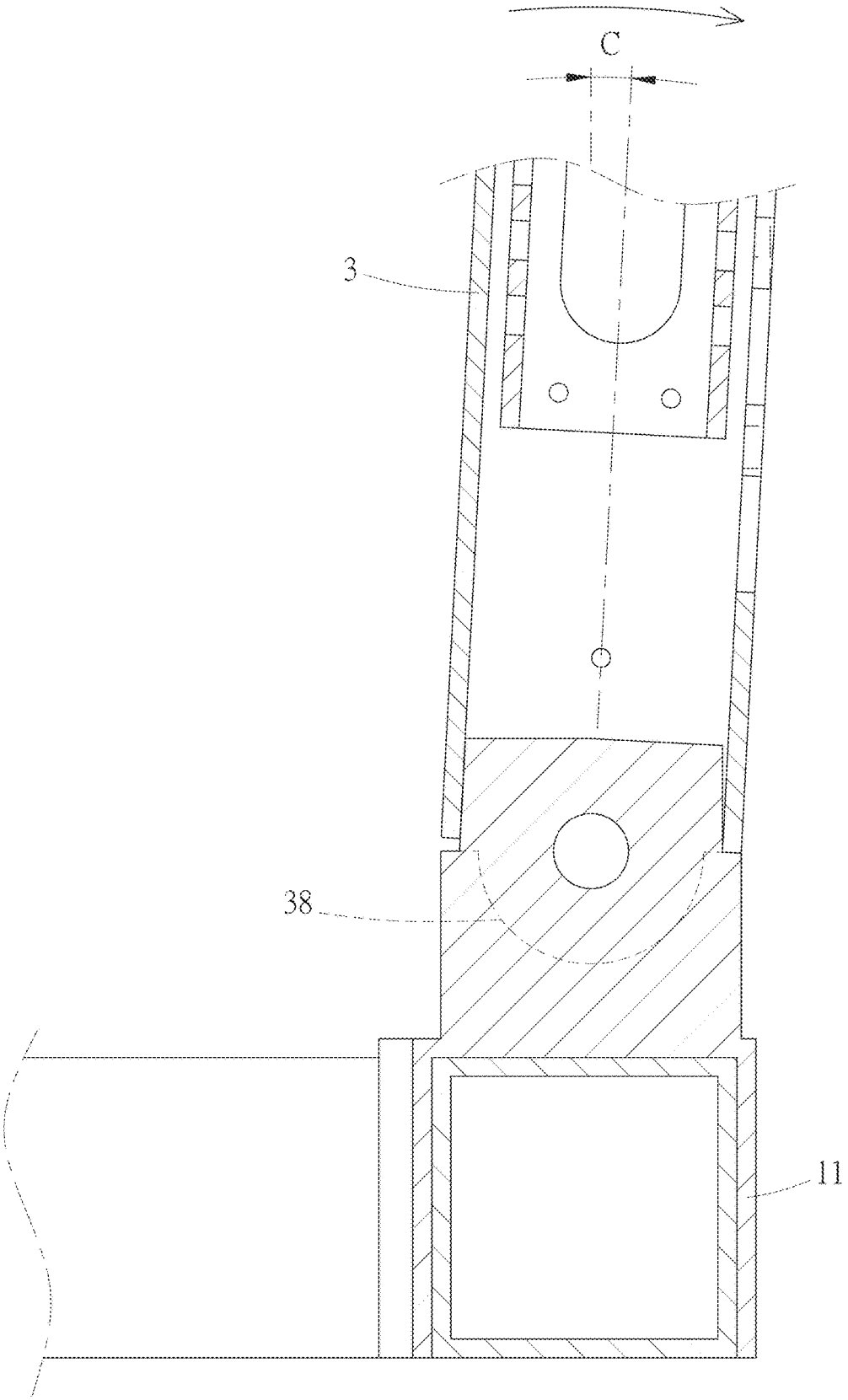
FIG. 25 is a schematic view illustrating that the front pole is pivoted inward by an angle according to the preferred embodiment of the present invention.
Figure 26:
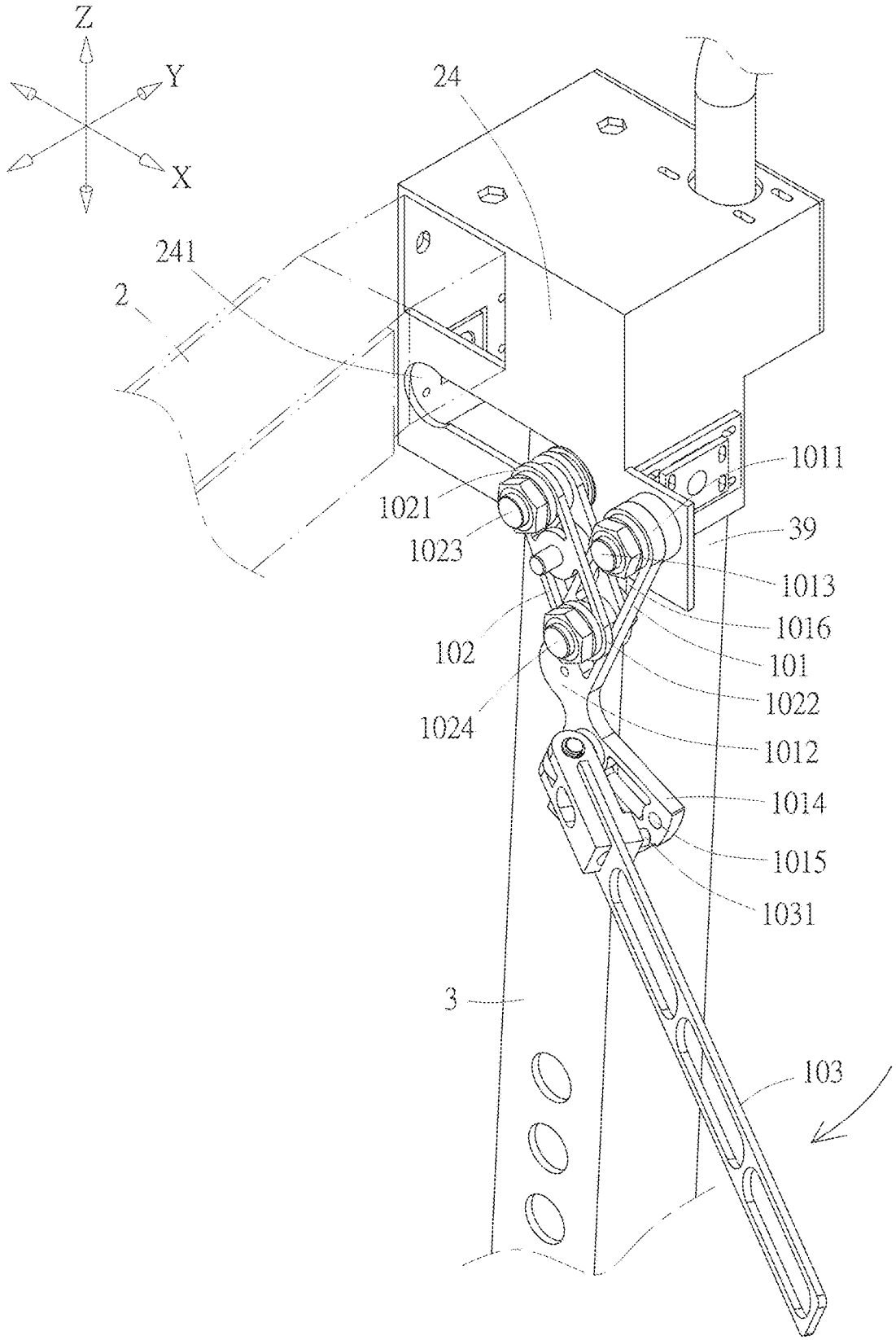
FIG. 26 is a schematic view illustrating that the operating handle is pulled in the Y direction to disengage the locking member from the positioning aperture according to the preferred embodiment of the present invention.
Figure 27:
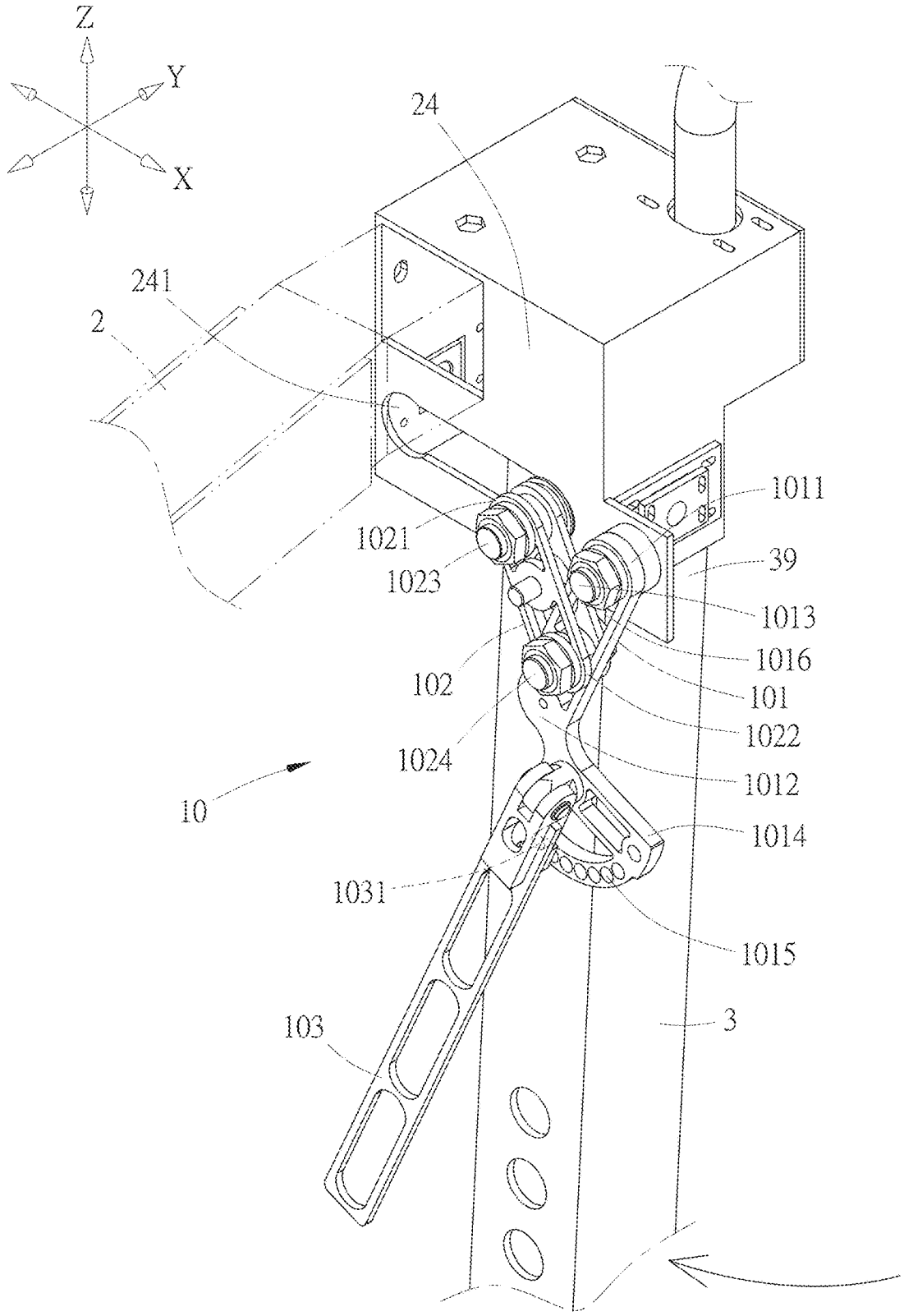
FIG. 27 is a schematic view illustrating that the locking member is engaged in another positioning aperture according to the preferred embodiment of the present invention.

When it is necessary for the two front poles to be relatively pivoted at the angle C inwardly in the X direction, as shown in FIG. 13, FIG. 21 and FIG. 22, through the angle adjustment unit 10 on the top end 39 of one of the front poles 3, the operating handle 103 rotates the driving rod 101 relative to the slide slot bracket 24 with the first shaft 1013 as the axis. Then, the driving rod 101 drives the second shaft 1023 of the first end portion 1021 of the driven rod 102 through the third shaft 1024 to move in the slide slot 241 along the X direction from the outer side to the inner side. As shown in FIG. 23, when the second shaft 1023 moves, it will simultaneously drive the top end 39 of the front pole 3 to be pivoted in the X direction with the pivot position of the bottom end 38 as the axis to adjust the predetermined angle C. The front pole 3 can be synchronized to move from the outer side to the inner side. Since the angle C is 3 degrees, as shown in FIG. 24, the front pole 3 is tilted toward the outside at another angle C1 of about 3 degrees before it is pivoted. After the front pole 3 is pivoted inwardly at the angle C, as shown in FIG. 25, the bottom end 38 is pressed against the pivot position of the corresponding externally-expanding foot 11 of the base 1. As shown in FIG. 26, after the top end 39 of the front pole 3 is adjusted at the appropriate angle C, the operating handle 103 is pulled in the Y direction, so that the locking member 1031 on the operating handle 103 is disengaged from the positioning aperture 1015, and then the operating handle 103 is rotated reversely relative to the restricting portion 1014. As shown in FIG. 27, the locking member 1031 on the operating handle 103 is locked in another positioning aperture 1015, so that the operating handle 103 can be hidden behind the front pole. In the same operation, the front pole 3 on the other side is pivoted inwardly at the angle C in the X direction, so that the two front poles 3 on both sides can be pivoted inwardly by the same angle C. When the barbell A straddles the barbell holders 51 of the front poles 3 and the weight disks A2 at both ends of the barbell A are too heavy, the weight disks A2 at both ends of the barbell A will have a slight sag. When the barbell A is to be lifted from the barbell holders 51, the weight disks A2 will not touch the barbell holders 51 and will not hinder the lifting of the barbell A because the two front poles 3 have been adjusted inwardly by the angle C to make a space.

As shown in FIG. 2, FIG. 20 and FIG. 22, the present invention may provide only one slide slot bracket 24 on the upper frame 2. The slide slot bracket 24 has the slide slot 241 in the X direction. The bottom end 38 of the front pole 3 is pivotally connected to the base 1, and the top end 39 of the front pole 3 is coupled to the slide slot bracket 24. The angle adjustment unit 10 is disposed on the slide slot bracket 24. The angle adjustment unit 10 is connected to the top end 39. In operation, the bottom end 38 of the front pole 3 at one side is pivoted for the front pole 3 to be adjusted inwardly in the X direction at the predetermined angle C, thereby allowing for adjustment of the angle C to make a space. Similarly, the weight disks A2 will not touch the barbell holders 51 and will not hinder the lifting of the barbell A.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An angle-adjustable Smith machine, comprising:

a base;

an upper frame located at a height from the base in a z direction, the upper frame including at least one slide slot bracket;

two front poles spaced apart from each other in an X direction, the two front poles extending in the Z direction, at least one of the two front poles having a bottom end pivotally connected to the base and a top end coupled to the at least one slide slot bracket;

two rear poles spaced apart from each other in the X direction, the two rear poles being located at a distance away from the two front poles in a Y direction, the two rear poles extending in the Z direction and being connected between the base and the upper frame, the X direction, the Y direction, and the Z direction being perpendicular to one another; and at least one angle adjustment unit disposed on the at least one slide slot bracket, the at least one angle adjustment unit being connected to the respective top end of a corresponding one of the two front poles;

wherein the at least one angle adjustment unit is configured for driving the respective top end of a corresponding one of the two front poles to move in the X direction for being subsequently secured, and thereby the respective bottom end of a corresponding one of the two front poles is pivoted in the X direction for the respective front pole to be adjusted at a predetermined angle; and wherein the at least one slide slot bracket has a slide slot in the X direction and wherein the at least one angle adjustment unit includes a driving rod, a driven rod, and an operating handle, the driving rod has two ends defined as a first end and a second end, the first end is pivotally connected to the at least one slide slot bracket via a first shaft and the second end is connected to a restricting portion, the operating handle is pivotally connected to the restricting portion, a slot is formed between the first end and the second end of the driving rod, the driven rod has two end portions defined as a first end portion and a second end portion, the first end portion is secured to the respective top end of a corresponding one of the two front poles through a second shaft passing through the slide slot, and thereby the second shaft is movable within the slide slot to drive the respective top end of a corresponding one of the two front poles to pivot relative to the respective bottom end of a corresponding one of the two front poles, and the second end portion of the driven rod is pivotally connected to a third shaft fixed in the slot.

2. The angle-adjustable Smith machine as claimed in claim 1, wherein the restricting portion includes a plurality of positioning apertures arranged in an arc from the X direction towards the Y direction, and a locking member is formed on the operating handle, and the locking member being selectively locked in one of the plurality of positioning apertures.

3. The angle-adjustable Smith machine as claimed in claim 1, wherein the driven rod includes two plates connected to each other.

4. The angle-adjustable Smith machine as claimed in claim 1, further comprising two movable poles, a plurality of positioning pins, and two force-applying rods, wherein the two front poles are hollow poles and each of the two front poles have a slide groove and a stop groove in the Z direction; the two movable poles are slidably inserted in the two front poles in the Z direction, respectively, each of the two movable poles includes at least one barbell holder, the at least one barbell holder of the two movable poles are exposed on the two front poles, each of the two movable poles have a plurality of positioning holes arranged in the Z direction and corresponding in position to the stop groove; the plurality of positioning pins are selectively inserted in the respective plurality of positioning holes; the two force-applying rods are pivotally connected to the respective two front poles; the two force-applying rods are movable to support exposed portions of the respective plurality of positioning pins through leverage, and thereby the two movable poles are movable up or down to relocate the plurality of positioning pins, and by relocating the plurality of positioning pins in different ones of the plurality of positioning holes, a corresponding position of the at least one barbell holder is adjustable in the Z direction.

5. The angle-adjustable Smith machine as claimed in claim 4, wherein the front pole includes a shaft holder and a first pivot shaft on the shaft holder, the first pivot shaft is pivotally connected to one end of a connecting plate, another end of the connecting plate is pivotally connected to the force-applying rod through a second pivot shaft, the force-applying rod has a hook portion extending forward from the second pivot shaft, and the force-applying rod is swingable between the front pole and the rear pole.

6. The angle-adjustable Smith machine as claimed in claim 5, wherein the shaft holder has a rotary shaft parallel to the Z direction, a rotary seat is pivotally connected to the rotary shaft, the rotary seat has an extension end pivotally connected to the first pivot shaft, and the first pivot shaft is perpendicular to the rotary shaft.

7. The angle-adjustable Smith machine as claimed in claim 4, wherein the at least one barbell holder includes two barbell holders on each of the two movable poles in the Z direction, and the two barbell holders are defined as an upper barbell holder and a lower barbell holder.

8. The angle-adjustable Smith machine as claimed in claim 7, wherein the upper barbell holder on each of the two movable poles is located away from the base and has an upper roller, each upper roller is a cylindrical roller, an axis of each upper roller is parallel to the Y direction; wherein the lower barbell holder on each of the two movable poles is located close to the base and has a lower roller, an axis of each lower roller is parallel to the Y direction, and a circumference of each lower roller has a recessed portion in the Y direction.

9. The angle-adjustable Smith machine as claimed in claim 1, further comprising two safety racks, wherein a plurality of safety rack positioning holes are formed on each of the two front poles in the Z direction and are located adjacent to the base, each of the two safety racks have a U-shaped mount corresponding in position to the plurality of safety rack positioning holes of a respective one of the two front poles, an inner wall of each U-shaped mount has protrusions, and the protrusions of each U-shaped mount are selectively engaged in the plurality of safety rack positioning holes of a respective one of the two front poles from different planes, and thereby each U-shaped mount surrounds a corresponding one of the two front poles and is selectively secured at different positions in the Z direction.

10. The angle-adjustable Smith machine as claimed in claim 1, wherein the base includes two outwardly-expanding feet, and the two outwardly-expanding feet are expanded from the two rear poles toward the two front poles.

11. The angle-adjustable Smith machine as claimed in claim 1, wherein the two rear poles are disposed obliquely in the Z direction, a distance between the two rear poles in the X direction gradually increases from the upper frame toward the base, a distance between a corresponding one of the two rear poles and a corresponding one of the two front poles in the Y direction gradually increases from the upper frame toward the base, and the two front poles are parallel relative to each other with respect to the Z direction.

12. The angle-adjustable Smith machine as claimed in claim 1, wherein the upper frame includes a pull-up bar, and the pull-up bar is straddled between the two front poles.

13. The angle-adjustable Smith machine as claimed in claim 1, further comprising at least one weight disk holder, wherein the two rear poles have a plurality of weight disk holder positioning holes arranged in a lengthwise direction of the respective one of the two rear poles, the at least one weight disk holder has a U-shaped seat corresponding to the plurality of weight disk holder positioning holes, an inner wall of the U-shaped seat of the at least one weight disk holder has a protruding portion selectively engaged in a respective one of the plurality of weight disk holder positioning holes in a corresponding planar direction, thereby the U-shaped seat of the at least one weight disk holder surrounds the respective one of the two rear poles and is configured to be selectively secured at different positions in the Z direction.

14. The angle-adjustable Smith machine as claimed in claim 13, wherein the at least one weight disk holder is movably pivoted to the respective U-shaped seat through a corresponding pivot member, and the at least one weight disk holder is rotatable by 90 degrees relative to the respective U-shaped seat in the lengthwise direction of a corresponding one of the two rear poles through the respective pivot member.

15. The angle-adjustable Smith machine as claimed in claim 1, wherein the upper frame includes a barbell bar holder, the barbell bar holder includes two holding pieces, and a spacing between the two holding pieces is less than a protruding section of a barbell bar.

16. An angle-adjustable Smith machine, comprising:

a base;

an upper frame located at a height from the base in a z direction, the upper frame including at least one slide slot bracket;

two front poles spaced apart from each other in an X direction, the two front poles extending in the Z direction, at least one of the two front poles having a bottom end pivotally connected to the base and a top end coupled to the at least one slide slot bracket;

two rear poles spaced apart from each other in the X direction, the two rear poles being located at a distance away from the two front poles in a Y direction, the two rear poles extending in the Z direction and being connected between the base and the upper frame, the X direction, the Y direction, and the Z direction being perpendicular to one another;

at least one angle adjustment unit disposed on the at least one slide slot bracket, the at least one angle adjustment unit being connected to the respective top end of a corresponding one of the two front poles; and two movable poles, a plurality of positioning pins, and two force-applying rods, wherein the two front poles are hollow poles and each of the two front poles have a slide groove and a stop groove in the Z direction; the two movable poles are slidably inserted in the two front poles in the Z direction, respectively, each of the two movable poles includes at least one barbell holder, the at least one barbell holder of the two movable poles are exposed on the two front poles, each of the two movable poles have a plurality of positioning holes arranged in the Z direction and corresponding in position to the stop groove; the plurality of positioning pins are selectively inserted in the respective plurality of positioning holes; the two force-applying rods are pivotally connected to the respective two front poles; the two force-applying rods are movable to support exposed portions of the respective plurality of positioning pins through leverage, and thereby the two movable poles are movable up or down to relocate the plurality of positioning pins, and by relocating the plurality of positioning pins in different ones of the plurality of positioning holes, a corresponding position of the at least one barbell holder is adjustable in the Z direction;

wherein the at least one angle adjustment unit is configured for driving the respective top end of a corresponding one of the two front poles to move in the X direction for being subsequently secured, and thereby the respective bottom end of a corresponding one of the two front poles is pivoted in the X direction for the respective front pole to be adjusted at a predetermined angle.

17. An angle-adjustable Smith machine, comprising:

a base;

an upper frame located at a height from the base in a z direction, the upper frame including at least one slide slot bracket;

two front poles spaced apart from each other in an X direction, the two front poles extending in the Z direction, at least one of the two front poles having a bottom end pivotally connected to the base and a top end coupled to the at least one slide slot bracket;

two rear poles spaced apart from each other in the X direction, the two rear poles being located at a distance away from the two front poles in a Y direction, the two rear poles extending in the Z direction and being connected between the base and the upper frame, the X direction, the Y direction, and the Z direction being perpendicular to one another; and at least one angle adjustment unit disposed on the at least one slide slot bracket, the at least one angle adjustment unit being connected to the respective top end of a corresponding one of the two front poles;

wherein the at least one angle adjustment unit is configured for driving the respective top end of a corresponding one of the two front poles to move in the X direction for being subsequently secured, and thereby the respective bottom end of a corresponding one of the two front poles is pivoted in the X direction for the respective front pole to be adjusted at a predetermined angle; and wherein the two rear poles are disposed obliquely in the Z direction, a distance between the two rear poles in the X direction gradually increases from the upper frame toward the base, a distance between a corresponding one of the two rear poles and a corresponding one of the two front poles in the Y direction gradually increases from the upper frame toward the base, and the two front poles are parallel relative to each other with respect to the Z direction.

* * * * *